US007472976B2

(12) United States Patent
Usuda

(10) Patent No.: US 7,472,976 B2
(45) Date of Patent: Jan. 6, 2009

(54) METHOD OF CONTROLLING FUNCTIONAL LIQUID SUPPLY APPARATUS, FUNCTIONAL LIQUID SUPPLY APPARATUS, LIQUID DROPLET EJECTION APPARATUS, METHOD OF MANUFACTURING ELECTRO-OPTICAL DEVICE, ELECTRO-OPTICAL DEVICE, AND ELECTRONIC DEVICE

(75) Inventor: Hidenori Usuda, Matsumoto (JP)

(73) Assignee: Seiko Epson Corporation (JP)

( * ) Notice: Subject to any disclaimer, the term of this patent is extended or adjusted under 35 U.S.C. 154(b) by 394 days.

(21) Appl. No.: 11/342,376

(22) Filed: Jan. 27, 2006

(65) Prior Publication Data

US 2006/0181583 A1 Aug. 17, 2006

(30) Foreign Application Priority Data

Feb. 16, 2005 (JP) ..... 2005-039495

(51) Int. Cl.
*B41J 2/195* (2006.01)
*B41J 29/393* (2006.01)

(52) U.S. Cl. ..... 347/7; 347/19

(58) Field of Classification Search ..... 347/7, 347/17, 19, 85; 141/2, 18
See application file for complete search history.

(56) References Cited

U.S. PATENT DOCUMENTS 5,912,688 A * 6/1999 Gragg ..... 347/86
6,084,617 A * 7/2000 Balazer ..... 347/86
6,513,902 B1 * 2/2003 Amano et al. ..... 347/23
6,666,549 B2 * 12/2003 Harada et al. ..... 347/85
6,733,114 B2 * 5/2004 Kobayashi et al. ..... 347/85

FOREIGN PATENT DOCUMENTS

| | | |
|---|---|---|
| JP | 2002-166569 | 6/2002 |
| JP | 2003-127418 | 5/2003 |
| JP | 2004-148822 | 5/2004 |
| JP | 2004-202797 | 7/2004 |
| KR | 2003-0043671 | 6/2003 |

OTHER PUBLICATIONS

Communication from Korean Patent Office regarding counterpart application, Feb. 9, 2007.

* cited by examiner

*Primary Examiner*—Anh T. N. Vo
(74) *Attorney, Agent, or Firm*—Harness, Dickey & Pierce, P.L.C.

(57) ABSTRACT

A method of controlling a functional liquid supply apparatus includes: a pressure-loss computing step for computing a pressure loss of each kind of a functional liquid flowing through respective functional liquid passages which extend from respective functional liquid tanks to a functional liquid droplet ejection head; a supply-pressure computing step for computing a supply pressure of each kind of the functional liquid with the pressure loss taken into consideration so that an in-head pressure of each kind of the functional liquid in the functional liquid droplet ejection head becomes a set pressure which is respectively set in advance; and an independent-pressurizing step for independently pressurizing the plurality of the functional liquid tanks based on the computed supply pressure.

7 Claims, 28 Drawing Sheets

METHOD OF CONTROLLING FUNCTIONAL LIQUID SUPPLY APPARATUS, FUNCTIONAL LIQUID SUPPLY APPARATUS, LIQUID DROPLET EJECTION APPARATUS, METHOD OF MANUFACTURING ELECTRO-OPTICAL DEVICE, ELECTRO-OPTICAL DEVICE, AND ELECTRONIC DEVICE

The entire disclosure of Japanese Patent Application No. 2005-039495, filed Feb. 16, 2005, is expressly incorporated by reference herein.

BACKGROUND

1. Technical Field

The present invention relates to: a method of controlling a functional liquid supply apparatus which pressurizes a plurality of functional liquid tanks to thereby supply under pressure each kind of functional liquid from each of the functional liquid tanks to a functional liquid droplet ejection head which ejects functional liquid droplets; a functional liquid supply apparatus; a liquid droplet ejection apparatus; a method of manufacturing an electro-optical device; an electro-optical device; and an electronic device.

2. Related Art

Among ink jet printers which are known as a kind of liquid droplet ejection apparatus, there is one in which ink cartridges (functional liquid tanks) are located blow a print head (functional liquid droplet ejection head). The ink cartridges are pressurized by an ink pressurizing means to thereby supply under pressure the ink (functional liquid) stored in the ink cartridges to the print head. JP-A-2002-166569 is an example of related art.

The functional liquid droplets to be ejected from the functional liquid droplet ejection head are extremely minute (ultra-fine). Therefore, the pressure of the functional liquid in passages inside the head (hereinafter also referred to as "in-head pressure") of the functional liquid droplet ejection head gives an influence on the functional liquid droplets to be ejected from the functional liquid droplet ejection head. Therefore, in order to perform imaging (drawing) at a high accuracy by using the functional liquid droplet ejection head, it is necessary to control the pressurizing force by the pressurizing means so that the in-head pressure becomes a predetermined set pressure.

However, in case the liquid droplet ejection apparatus has a plurality of functional liquid tanks for storing therein plural kinds of functional liquids which are different from one another, there is the following problem. Namely, if these functional liquid tanks are pressurized at a uniform pressure, there will be a difference in pressure loss due to the difference in the viscosity, or the like, of each of the functional liquids, even if the lengths and diameters of tubes to the in-head passages are made the same. As a result, the in-head pressure cannot be made to the predetermined set pressure and may give an adverse effect on the imaging operation.

SUMMARY

The invention has an advantage of providing: a method of controlling a functional liquid supply apparatus which is capable of supplying various kinds of functional liquids so as to attain a predetermined in-head pressure, in case plural kinds of different functional liquids are stored in a plurality of functional liquid tanks; a functional liquid supplying apparatus; a liquid droplet ejection apparatus; a method of manufacturing an electro-optical device; an electro-optical device; and an electronic device.

According to a first aspect of the invention, a method controls a functional liquid supply apparatus, the apparatus having a plurality of functional liquid tanks each storing therein a functional liquid different in kind from one another, the functional liquid tanks being respectively pressurized by a plurality of corresponding pressurizing pumps so as to supply each kind of the functional liquid under pressure from the respective functional liquid tanks to the functional liquid droplet ejection head which ejects the functional liquid droplets. The method comprises: a pressure-loss computing step for computing a pressure loss of each kind of the functional liquid flowing through respective functional liquid passages which extend from the respective functional liquid tanks to the functional liquid droplet ejection head; a supply-pressure computing step for computing a supply pressure of each kind of the functional liquid with the pressure loss taken into consideration so that an in-head pressure of each kind of the functional liquid in the functional liquid droplet ejection head becomes a set pressure which is respectively set in advance; and an independent-pressurizing step for independently pressurizing the plurality of the functional liquid tanks based on the computed supply pressure.

According to another aspect of the invention, a functional liquid supply apparatus has a plurality of functional liquid tanks each storing therein a functional liquid different in kind from one another, and a plurality of corresponding pressurizing pumps to pressurize the functional liquid tanks so as to supply each kind of the functional liquid under pressure from the respective functional liquid tanks to the functional liquid droplet ejection head which ejects the functional liquid droplets. The apparatus comprises: a pressure-loss computing means for computing a pressure loss of each kind of the functional liquid flowing through respective functional liquid passages which extend from the respective functional liquid tanks to the functional liquid droplet ejection head; a supply-pressure computing means for computing a supply pressure of each kind of the functional liquid with the pressure loss taken into consideration so that an in-head pressure of each kind of the functional liquid in the functional liquid droplet ejection head becomes a set pressure which is respectively set in advance; and an independent-pressurizing means for independently pressurizing the plurality of the functional liquid tanks based on the computed supply pressure.

In accordance with embodiments of the invention, the pressure loss in the functional liquid passages is computed corresponding to each of the different functional liquids. The functional liquid supply pressure is then obtained for each of the functional liquids by taking into consideration the computed pressure loss. Based on the obtained functional liquid supply pressure, the plural functional tanks respectively containing therein each of the functional liquids are independently pressurized by the plural pressurizing pumps. Therefore, the pressure of the ink at the time of reaching the in-head passage inside the functional liquid droplet ejection head can be made to be a predetermined set pressure, thereby preventing the ink inside the in-head passage from giving rise to pressure fluctuations. In this case, the set pressure may be made to be a pressure taking into consideration the ejecting performance, or the like, of the functional liquid droplet ejection head. The set pressure may be made equal to all of the functional liquids, or may be set to pressures which are different from functional liquid to functional liquid.

It is preferable that the pressure-loss computing step further comprises: a viscosity-data inputting step for inputting viscosity data of the various kinds of functional liquids; and a pressure-loss setting step for setting the pressure loss based on the inputted viscosity data and pressure-loss setting information in which the viscosity data and the pressure loss are correlated with each other.

It is preferable that the pressure-loss computing means further comprises: a viscosity-data inputting means for inputting viscosity data of the various kinds of functional liquids; and a pressure-loss setting means for setting the pressure loss based on the inputted viscosity data and pressure-loss setting information in which the viscosity data and the pressure loss are correlated with each other.

In accordance with embodiments of the invention, the pressure loss can be computed in compliance with the inputted viscosity data of the functional liquids by reference to the pressure-loss setting information. In this case, the pressure-loss setting information may be in the form of a table or in the form of an equation between the viscosity data and the pressure loss.

It is preferable that the supplying under pressure of the functional liquids is performed by driving the pressurizing pumps by pressurizing each of the functional liquid tanks so as to maintain a predetermined working pressure, and that the independent-pressurizing step comprises: a pressure-detecting step for detecting as to whether the functional liquid supply pressure, which is made to be the working pressure, reaches a lower-limit pressure of the working pressure; and a pressurizing step for pressurizing the functional liquid tank that has not reached the lower-limit pressure to an upper-limit pressure of the working pressure.

It is also preferable that the supplying under pressure of the functional liquids is performed by driving the pressurizing pumps by pressurizing each of the functional liquid tanks so as to maintain a predetermined working pressure and that the independent-pressurizing means comprises: a pressure-detecting means for detecting as to whether the functional liquid supply pressure, which is made to be the working pressure, reaches a lower-limit pressure of the working pressure; and a pressurizing means for pressurizing the functional liquid tank that has not reached the lower-limit pressure to an upper-limit pressure of the working pressure.

In accordance with embodiments of the invention, since the working pressure of the pressurizing pump is the functional liquid supply pressure which can make the in-head pressure to the predetermined set pressure, the functional liquid to be supplied under pressure can be maintained at the yielded functional liquid supply pressure. The in-head pressure can thus be maintained at the set pressure.

According to another aspect of the invention, a liquid droplet ejection apparatus comprises the above-referenced functional liquid supply apparatus. The liquid droplet ejection apparatus drives the functional liquid droplet ejection head while moving the functional liquid droplet ejection head relative to an imaging target, thereby performing imaging on the imaging target.

In accordance with an embodiment of the invention, the liquid droplet ejection apparatus comprises the above-referenced functional liquid supply apparatus which can make the in-head pressure to a predetermined set pressure. Therefore, the in-head pressure of the functional liquid in the functional liquid droplet ejection head does not fluctuate from the set pressure. As a result, the fluctuations in the ejection amount, the ejection speed, or the like, of the functional liquid droplets due to the variations in the in-head pressure can be effectively reduced, thereby performing a highly accurate imaging operation.

According to yet another aspect of the invention, a method of manufacturing an electro-optical device comprises forming a film-forming portion on the imaging target by using the above-referenced liquid droplet ejection apparatus.

According to still another aspect of the invention, an electro-optical device manufactured by using the above-referenced liquid droplet ejection apparatus comprises a film-forming portion formed with the functional liquid droplets on the imaging target.

In accordance with embodiments of the invention, the electro-optical device is manufactured by using the liquid droplet ejection apparatus capable of materializing highly accurate imaging. Therefore, a highly reliable electro-optical device can be manufactured. As the electro-optical device (flat panel display), the following can be listed as examples, i.e., a color filter, a liquid crystal display device, an organic electro-luminescence (EL) device, a plasma display panel (PDP device), an electron emission device, or the like. The electron emission device is a general concept inclusive of the so-called field emission display (FED) and surface-conduction electron-emitter display (SED). As the electro-optical device, there can be listed the device inclusive of forming of metallic wiring, forming of a lens, forming of a resist, and forming of a light diffusion material.

According to another aspect of the invention, the electronic device comprises the above-referenced electro-optical device.

The electronic device includes, e.g., a mobile phone, a personal computer, and various electric devices having mounted thereon a so-called flat panel display.

BRIEF DESCRIPTION OF THE DRAWINGS

The invention will be described with reference to the accompanying drawings, wherein like numbers reference like elements.

DESCRIPTION OF EXEMPLARY EMBODIMENTS

The invention will be described with reference to the accompanying drawings. As a first embodiment of the invention, a description will be made about an ink jet printer which is a kind of a liquid droplet ejection apparatus. This ink jet printer is a large-sized color printer which is used by connecting it to a host computer such as a personal computer, or the like. Based on printing data transferred from the host computer, the ink jet printer performs printing by a jet printing method on a roll of paper (also referred to as a roll paper) which serves as an imaging target or an object to be printed thereon.

Figure 1:
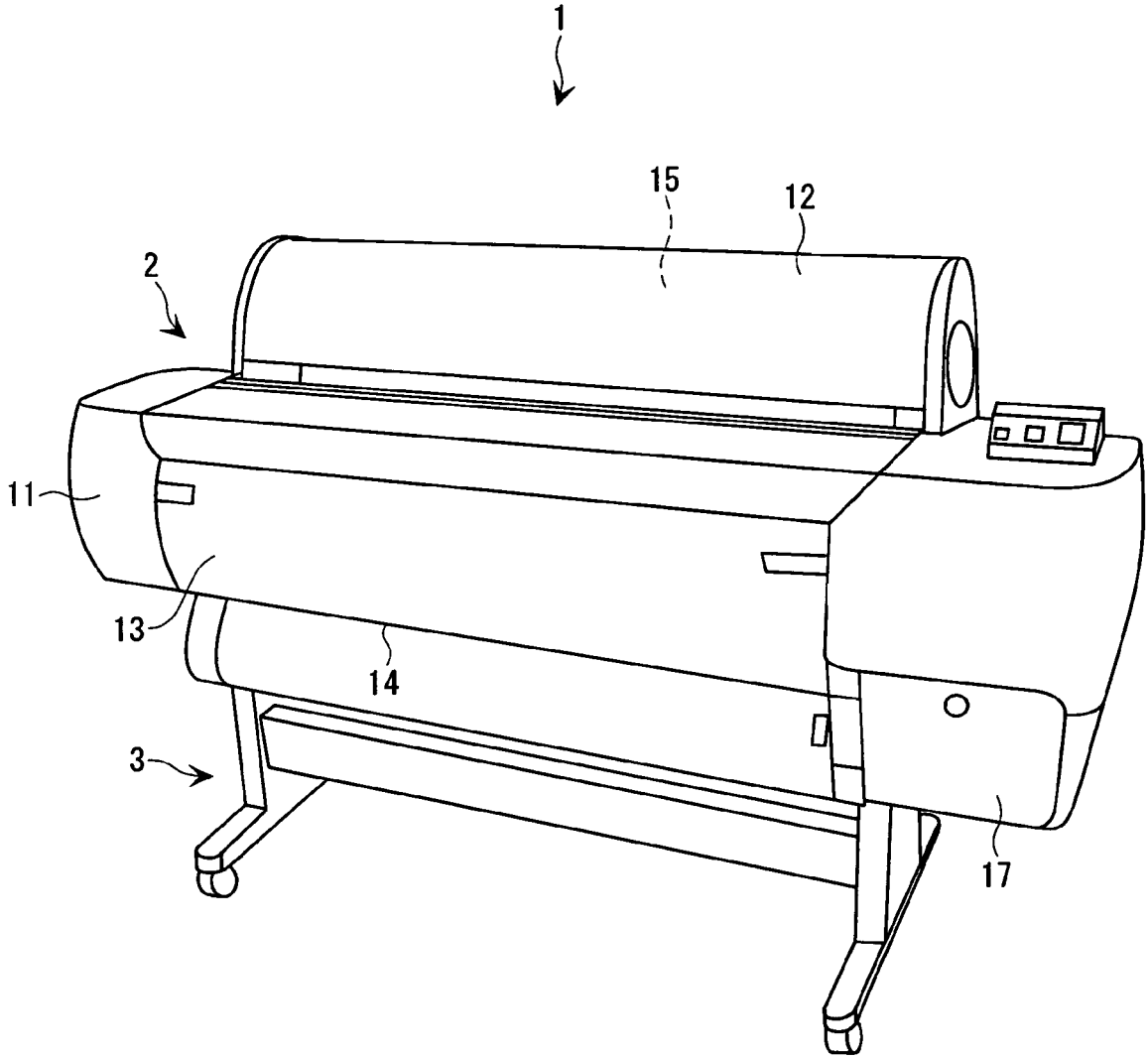
FIG. 1 is an outside perspective view of an ink jet printer according to a first embodiment of the invention.
Figure 2:
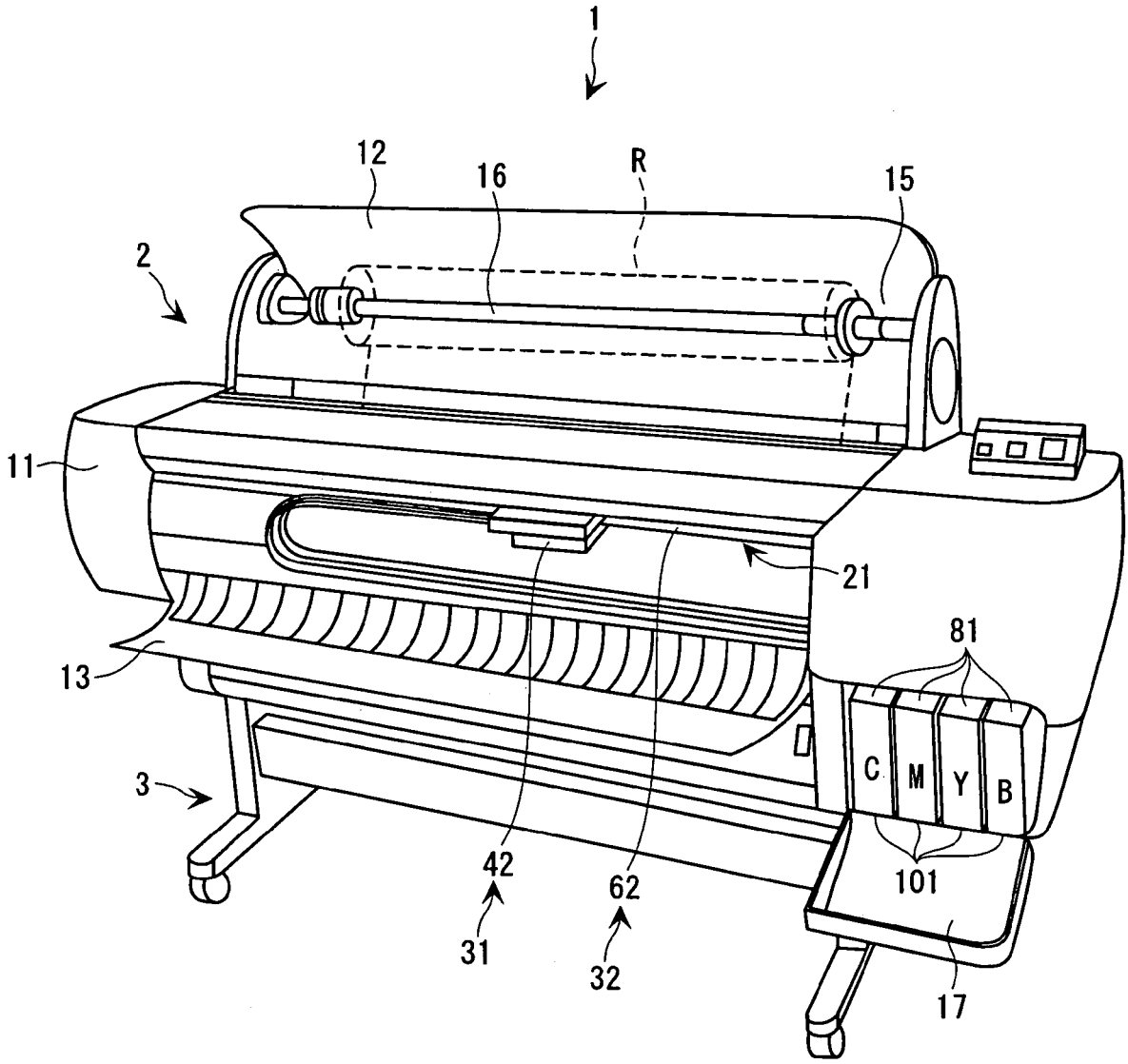
FIG. 2 is an outside perspective view of the ink jet printer of the first embodiment of the invention in which a roll-paper cover, an open/close cover and a cartridge cover are left open.

As shown in FIGS. 1 and 2, the ink jet printer 1 is made up of a printer main body 2 having an ink jet head 41 (to be described later), and a supporting stand 3 which supports the printer main body 2.

The printer main body 2 is covered on its outer frame with an apparatus casing 11 and is provided, on an upper rear portion thereof, with a roll-paper cover 12 for detachably mounting a roll paper R. From a front of the roll-paper cover 12 to a front of the printer main body 2, there is detachably provided an open/close cover 13 in a manner to open the inside to free access. The apparatus casing 11 has formed therein a cartridge cover 17 for detachably mounting ink cartridges 81. In the front of the printer main body 2, there is formed a paper discharge opening 14 for discharging the printed roll paper R in a position below the open/close cover 13. On the inside of the roll-paper cover 12, there is provided a roll-paper containing section 15 for detachably containing therein the roll paper R. Inside the open/close cover 13, on the other hand, there is formed a feeding passage (not shown) to feed the paid-out roll paper R to the discharge opening 14, along which is provided a printing means 21 for performing printing on the roll paper R.

Figure 7:
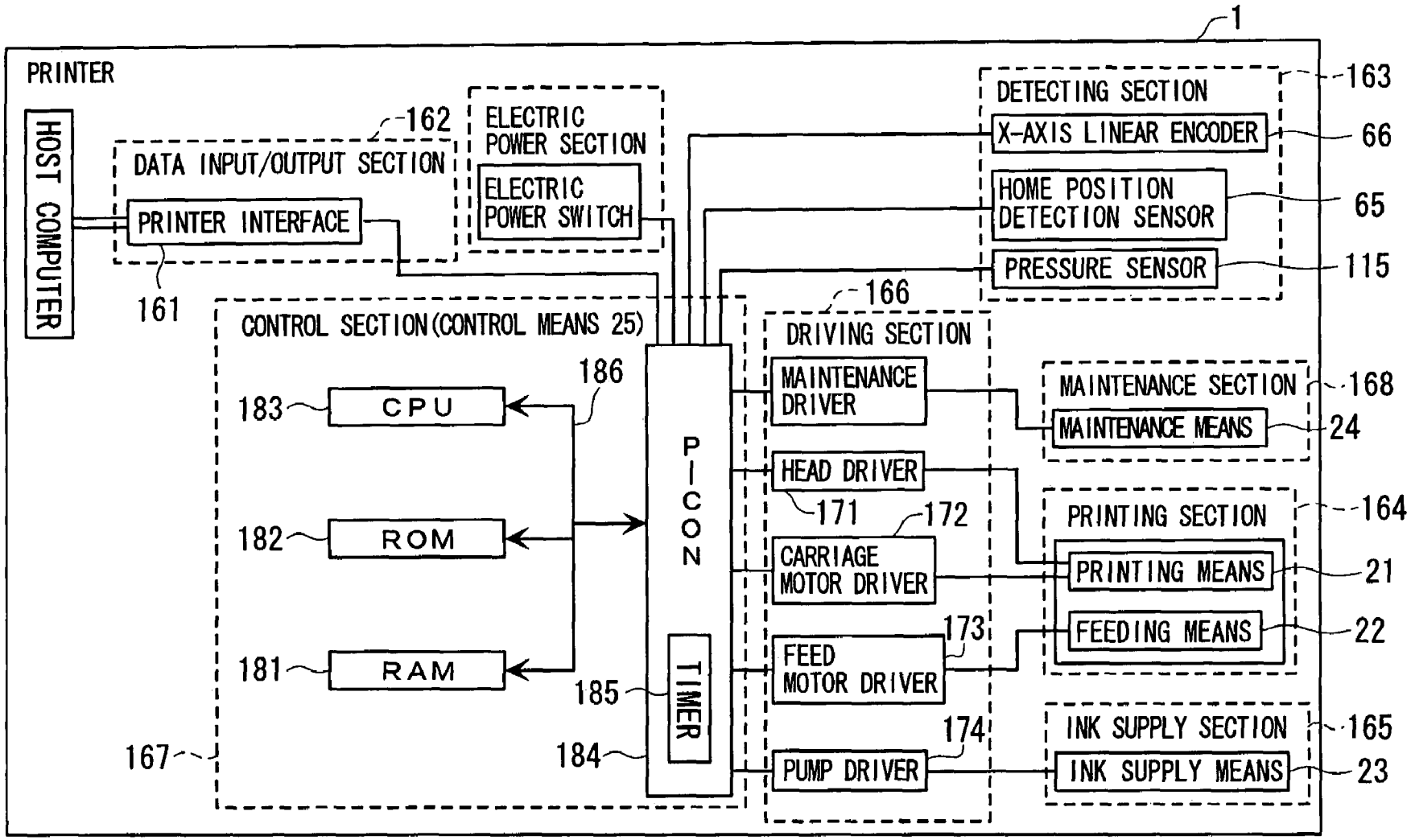
FIG. 7 is a control block diagram of the ink jet printer.
Figure 8:
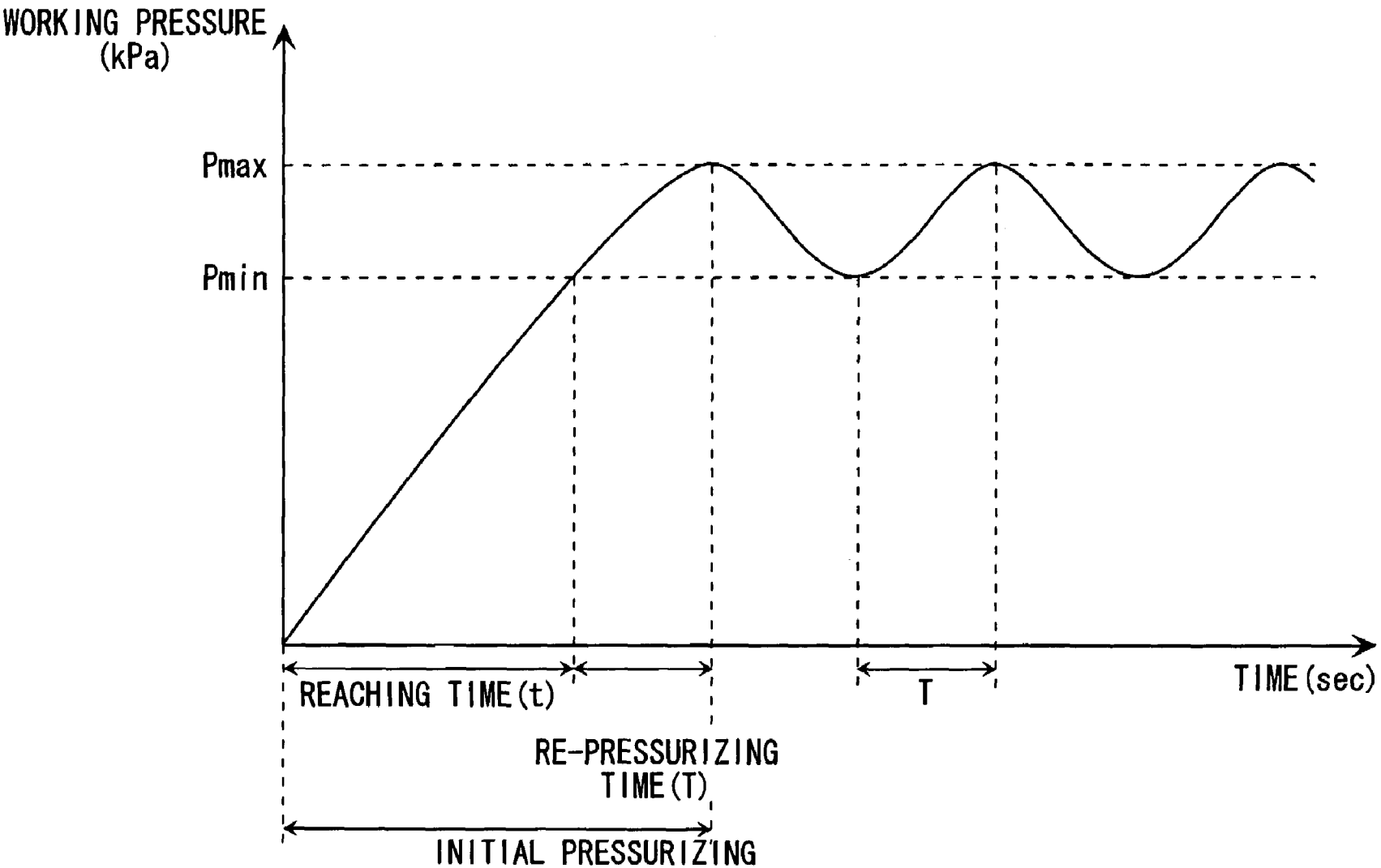
FIG. 8 is a graph explaining a method of driving a pressurizing pump.

The ink jet printer 1 is made up, as its basic construction, of: a printing means 21 having an ink jet head 41 and for performing printing on the roll paper R; feeding means 22 for feeding the roll paper R along the passage; ink supply means 23 having ink cartridges 81 and for supplying the ink jet head 41 with ink; maintenance means 24 for performing maintenance work on the ink jet head 41; and control means 25 for controlling these means in cooperation with each other to thereby control the entire ink jet printer 1 (see FIG. 7). While feeding the ink jet head with ink by the ink supply means 23, the printing means 21 and the feeding means 22 are synchronously driven to thereby perform printing on the roll paper R.

The printing means 21 is provided with: a head unit 31 having mounted thereon the ink jet head 41; and a head moving mechanism 32 which movably supports the head unit 31.

Figure 3:
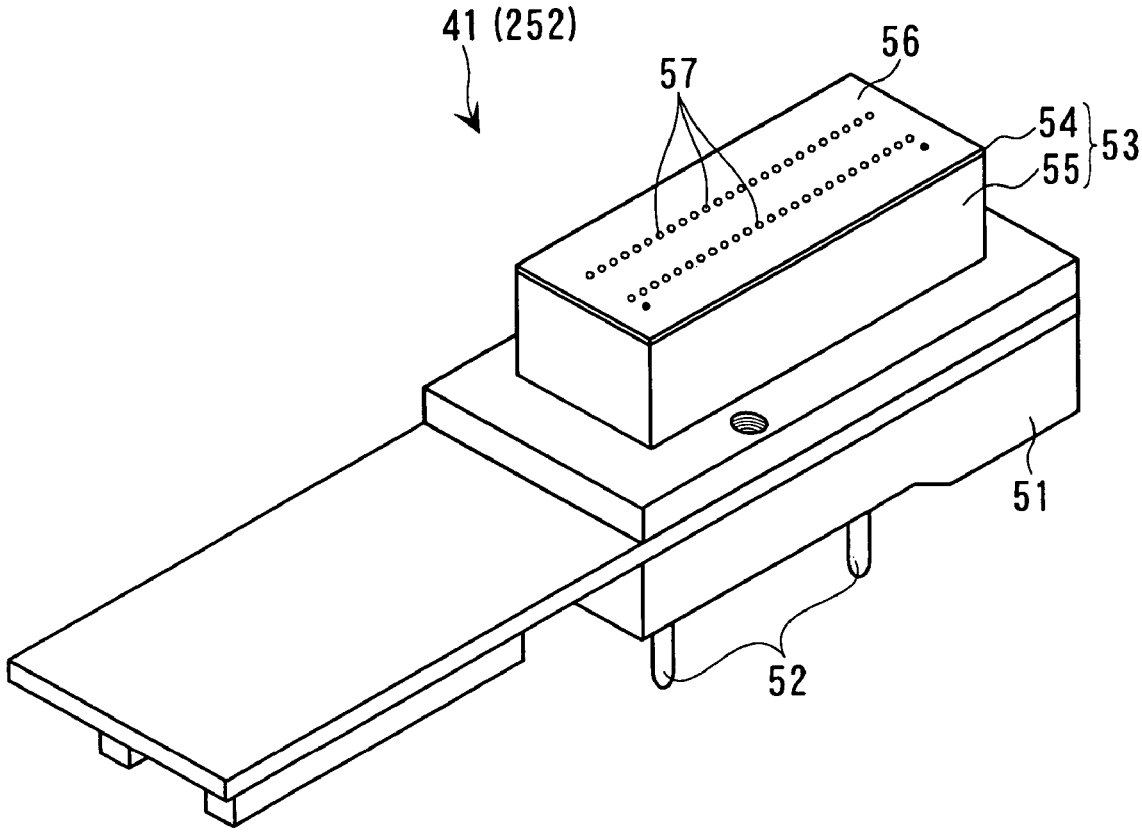
FIG. 3 is an outside perspective view of an ink jet head (functional liquid droplet ejection head).

The head unit 31 is made up of a plurality of ink jet heads 41 for ejecting ink (droplets), the ink jet heads 41 being mounted on a carriage 42. As shown in FIG. 3, each ink jet head 41 has an ink introducing port 51 provided with connection needles 52 for independently (or separately) receiving ink supply from the ink supply means 23; and a head main body 53 which is communicated with the lower portion of the ink introduction port 51 and which ejects the supplied ink. The head main body 53 is made up of a case 55 into which is assembled a nozzle plate 54 and a piezoelectric element. The nozzle plate 54 has a nozzle surface 56 having formed therein a multiplicity (360 pieces) of ejection nozzles 57. The ink jet head 41 is arranged to eject ink droplets out of the ejection nozzles 57 through compression of the piezoelectric elements inside the case 55.

The ink jet head 41 of the invention is each in a so-called double-row type and is provided at the ink introducing port 51 with two connection needles 52 respectively supplied with the ink. The nozzle plate 54 (nozzle surface 56) has formed therein two nozzle rows which are respectively supplied with the ink from each of the connection needles 52. Each of the nozzle rows has a multiplicity (180 pieces) of ejection nozzles 57 disposed at an equal pitch, the rows being formed at a deviation of half a pitch (about 70 μm) from each other. Therefore, it is possible to supply each nozzle row of this ink jet head 41 with different kinds of inks so that two kinds of inks can be ejected from a single ink jet head 41. It is also possible to use the two nozzle rows together to eject the ink at half a pitch (i.e., to perform imaging of higher resolution).

Figure 4:
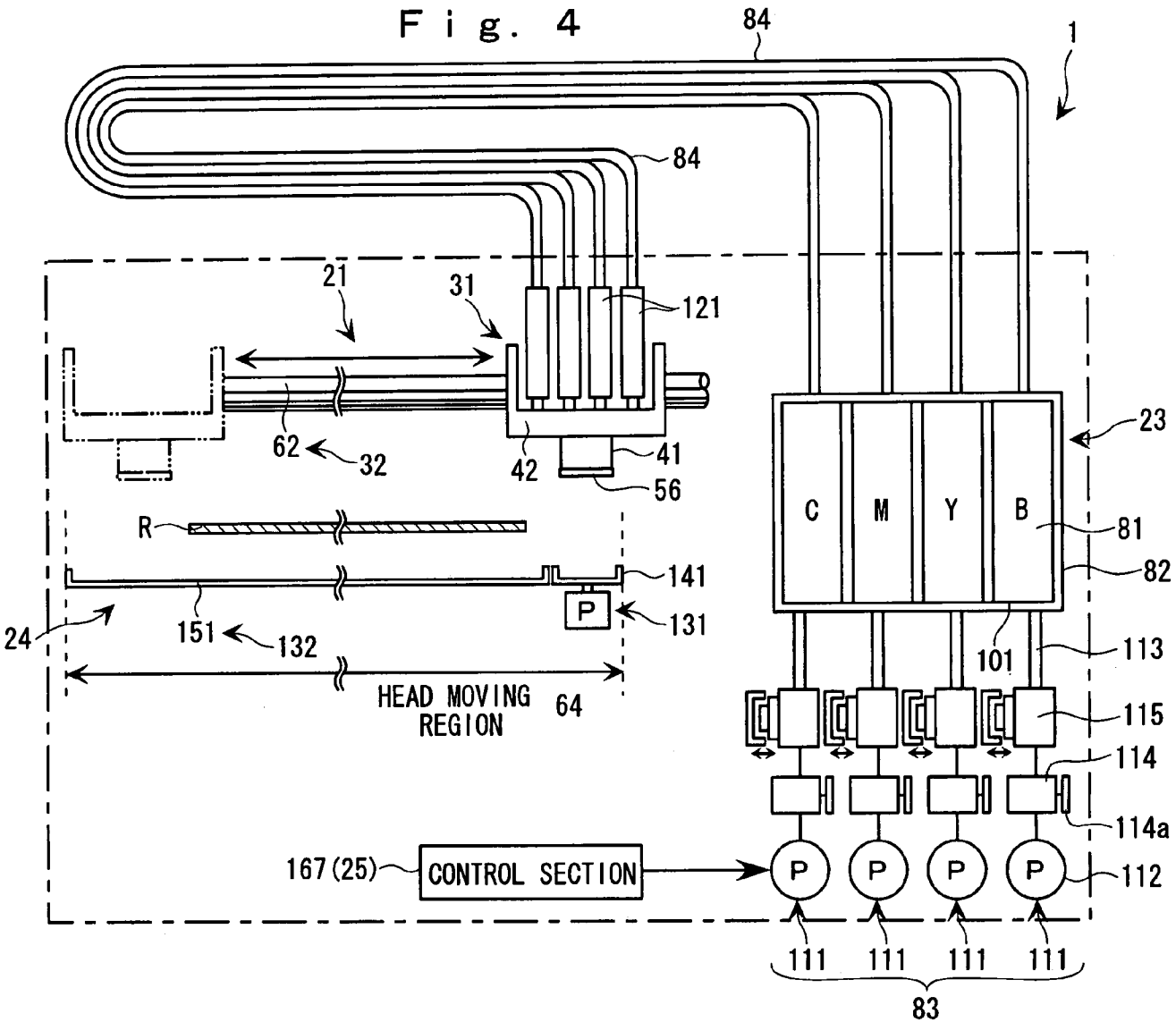
FIG. 4 is a schematic diagram of the ink jet printer.

As shown in FIG. 4, the carriage 42 holds the plurality of ink jet heads 41 in an aligned state. Once the plurality of ink jet heads 41 are fixed to the carriage 42 in an aligned state, the carriage 41 forms a predetermined imaging line made up of the nozzle rows of each of the ink jet heads 41. The imaging line means an arrangement of nozzle rows (ejection nozzles 57) which are in succession in the direction of feeding the roll paper R (Y-axis direction) and to which the ink of the same color is supplied. In this embodiment, it is so arranged that four imaging lines are formed on the carriage 42 corresponding to the four colors to be supplied by the ink supply means 23.

The head moving mechanism 32 serves to move the head unit 31 (carriage 42) in the X-axis direction (main scanning direction) which crosses the direction of feeding the roll paper R (Y-axis direction) at right angles, and is provided with: a carriage motor (not shown); a power transmission mechanism (not shown) which transmits the power of the carriage motor to thereby move the carriage 31 in the X-axis direction; and a guide member 62 which supports the head unit 31 so as to be slidable in the X-axis direction and which extends in the X-axis direction so as to guide the movement of the head unit 31.

The carriage motor is constituted by a DC motor which can be rotated in one direction and in the opposite (reverse) direction. The power transmission mechanism is made up of: a pair of pulleys (not shown); and a timing belt (not shown) which bridges over the pair of pulleys and in which a base portion of the carriage 42 is fixed so that the nozzle surface 56 of the ink jet head 41 becomes parallel with the feeding passage. To one of the pulleys is connected the carriage motor and, when the carriage motor rotates in one direction and in the opposite direction of rotation, the power is transmitted to the head unit 31 through the timing belt. The carriage 42 thus moves back and forth in the X-axis direction with the guide member 62 serving as a guide.

The head moving mechanism 32 is constituted so as to move the head unit 31 back and forth within a head moving region 64 which is set in advance. In this embodiment, the position on the right end of the head moving region 64 as seen in the figure is set to correspond to the home position of the head unit 31. With this position serving as a reference position, the moving position of the head unit 31 is recognized.

In concrete, the ink jet printer 1 is provided with a home position detection sensor 65 which detects the home position of the head unit 31 and is also provided with an X-axis linear encoder 66 which is made up of a photo-sensor mounted on the carriage 42 and a linear scale disposed in parallel with the guide member 62 and extending in the X-axis direction. The home position of the head unit 31 is detected by the home position detection sensor 65, and then, by detecting the plurality of detection lines provided in the linear scale by means of the photo-sensor, the position of the head unit 31 which moves within the head moving region 64 can be sequentially recognized.

The feeding means 22 serves to pay out (feed) the roll paper R contained in the roll-paper containing section 15 and also to feed the paid-out roll paper R along the feeding passage. The feeding means 22 is made up of: a motor (not shown) which serves as the driving source for paying out the roll paper R; and a feeding roller (not shown) which is disposed so as to face the feeding passage and which is connected to the feeding motor through a power transmission mechanism (not shown) to thereby pay out the roll paper R. Within the head moving region 64, there is set a printing region so as to correspond to the width of the set roll paper R. The roll paper R is fed by the feeding means 22 so as to pass through this printing region.

In the ink jet printer 1, the head driving mechanism 32 is driven to move the head unit 31 in the X-axis direction, whereby a plurality of ink jet heads 41 are selectively driven. By thus repeatedly performing the main scanning to eject the ink droplets to the roll paper R and the sub-scanning to feed the roll paper R by driving the feeding means 22, the imaging of the desired pictures on the roll paper R can be performed.

As shown in FIG. 4, the ink supply means 23 is made up of: four ink cartridges 81 in which are respectively stored inks of yellow (Y), magenta (M), cyan (C) and black (B) in color; a cartridge holder 82 for containing therein the four ink cartridges 81; a pressurizing means 83 which supplies each ink cartridge 81 with air to thereby pressurize the ink cartridge 81 whereby the ink in each of the ink cartridges 81 is sent (or fed) under pressure; and a plurality of (four in this embodiment) liquid supply tubes 84 which connect the four ink cartridges 81 and the (plurality of) ink jet heads 41 together.

Figure 5:
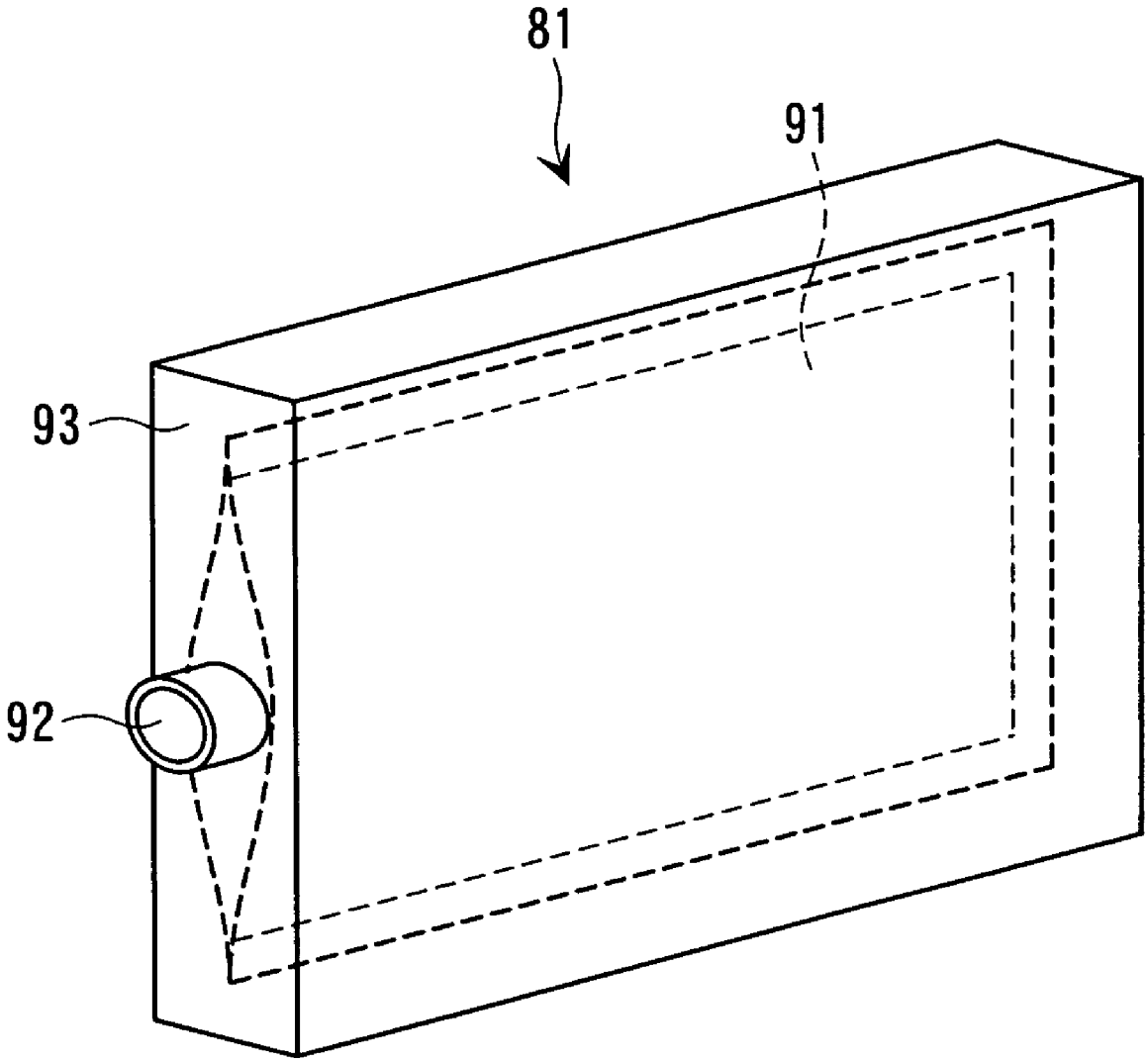
FIG. 5 is an outside perspective view of an ink cartridge.

As shown in FIG. 5, each ink cartridge 81 has an ink pack 91 which contains therein an ink; and a cartridge case 93 which contains (or houses) the ink pack 91 therein. The ink pack 91 is made by overlapping two rectangular and flexible film sheets together and then subjecting them to thermal welding into a bag, and then attaching a resin supply port 92 for supplying ink therefrom. The cartridge case 93 contains therein the ink pack 91 in a hermetically sealed manner and is provided with an air supply port (not shown) which is in communication with air piping 113 (to be described later) of the pressurizing means 83. In other words, when the air supply port supplies air into the cartridge case 93, the ink pack 91 is supplied with air in the periphery (surrounding) thereof, thereby pressurizing the ink pack from outside.

The cartridge holder 82 is disposed in a position lower than the nozzle surface of the ink jet head 41 in a fixed manner. The cartridge holder 81 has four cartridge mounting portions 101 for mounting therein ink cartridges 81 of predetermined colors. Each cartridge mounting portion 101 is provided with a connection adapter (not shown). When the ink cartridge 81 is mounted on the cartridge mounting portion 101, the air piping 113 and the cartridge casing are connected together in a hermetically sealed manner through a connection adapter.

The pressurizing means 83 serves to independently (or separately) supply air into each of the ink cartridges 81 (cartridge cases 93) to thereby independently pressurize the respective ink cartridges 81. The pressurizing means 83 is therefore provided with four air supply mechanisms 111 each having an independent driving system for each of the four ink cartridges 81.

Each of the air supply mechanisms 111 is made up of: a pressurizing pump 112 which supplies each of the ink cartridges 81 with air to thereby pressurize it; air piping 113 (air passage) which connects the pressurizing pump 112 and each of the ink cartridges 81; a regulator 114 which is interposed in the air piping 113; and a pressure sensor 115 which is interposed in the air piping 113 located on the downstream of the regulator 114 to detect the pressure inside the air passage, thereby detecting the pressurizing force to be applied to the ink pack 91.

The pressurizing pump 112, which is of a diaphragm type, transmits the power of the pump motor (stepping motor) to the diaphragm which constitutes a part of the pump chamber, through the power transmission mechanism. The volume of the pump chamber thus increases or decreases to thereby suck or supply the air (not shown). When the pressurizing pump 112 is driven, the air is supplied through the air piping 113, whereby the cartridge case 93 is pressurized. As a result, the ink pack 91 contained inside the ink cartridge 81 is pressurized, whereby the ink stored in the ink pack 91 is supplied under pressure.

Each of the air piping 113 has one end connected to each of the respective pressurizing pumps 112 and the other end connected to each of respective four connection adapters (not shown) which are disposed in respective cartridge mounting portions 101. In this arrangement, the air to be supplied from the respective pressurizing pumps 112 is supplied to the respective four ink cartridges 81 (cartridge cases 93).

The regulator 114 is a safety valve (relief valve) which serves the function of preventing the pressure inside the air passage (pressurizing force of the cartridge case 93) from exceeding a predetermined pre-set upper-limit pressure (14 Kpa in this embodiment). The regulator 114 is provided with a solenoid **114*a* which serves to open the air passage to the atmosphere when the ink jet printer 1** is not in operation.

The pressure sensor 115 is an ON/OFF sensor which is constituted by a photo-coupler, or the like to detect as to whether the pressure inside the air passage has reached a set pressure or not. Although the details are given hereinafter, the pressure sensor 115 is connected to the control means 25. Based on the result of detection by the pressure sensor 115, the control means 25 drives the pressurizing pump 112. The ink supply pressure of the ink to be supplied from the ink cartridge 81 is kept within a predetermined working pressure (or operating pressure).

Each of the liquid supply tubes 84 is connected, at one end thereof, to the connection needle 52 of the ink jet head 41 and, at the other end thereof, to the supply port 92 of the ink cartridge 81. The four liquid supply tubes 84 are contained in a bundle in a cable support member (known by a trademark of "Cableveyor"; not shown) so that they can move to follow the movement of the head unit 31 (carriage 42).

The cartridge 42 on which the ink jet head 41 is mounted has mounted thereon, as shown in FIG. 4, a plurality of pressure regulating valves 121 for adjusting the pressure of the ink to be supplied from the ink cartridge 81. The pressure regulating valves 121 are interposed in the liquid supply tubes 84.

Figure 6:
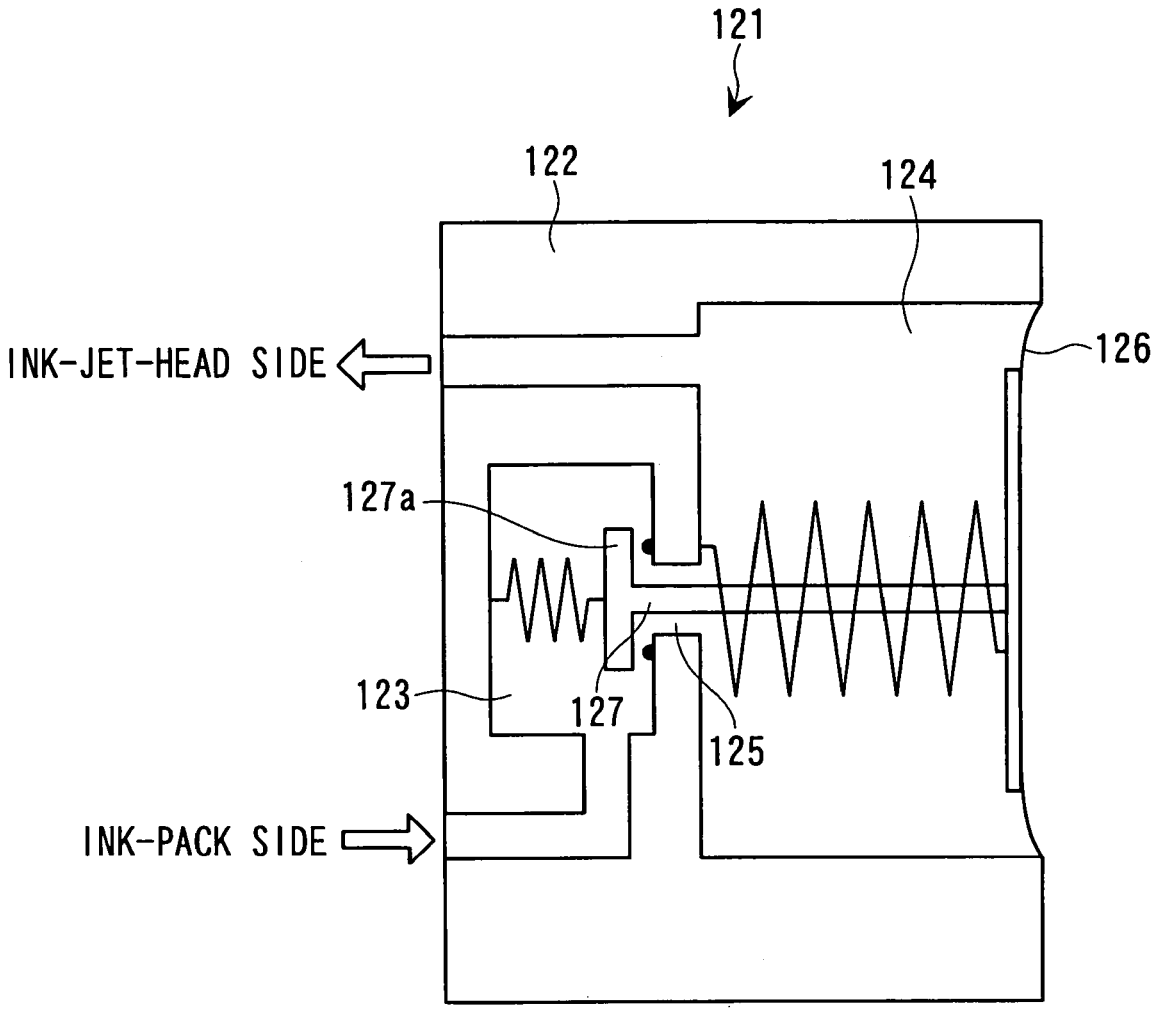
FIG. 6 is a schematic diagram of a pressure-regulating valve.

As shown in FIG. 6, the pressure regulating valve 121 has formed inside a valve housing 122: a primary chamber 123 which is in communication with the ink cartridge 81; a secondary chamber 124 which is in communication with the ink jet head 41; and a communication passage 125 which brings the primary chamber 123 and the secondary chamber 124 into communication with each other. A diaphragm 126 (resin film) is provided in one face of the secondary chamber 124 so as to face the outside thereof. The communication passage 125 is provided with a valve body 127 which is opened and closed by the diaphragm 126.

The functional liquid introduced from the ink cartridge 81 into the primary chamber 123 is supplied to the ink jet head 41 through the secondary chamber 124. At this time, by opening and closing the valve body 127 provided in the communication passage 125 with the atmospheric pressure operating on the diaphragm 126 serving as an adjusting reference pressure, the pressure adjustment inside the secondary chamber 124 is performed. In this case, the pressure fluctuation on the side of the ink pack 91 (primary side) can be kept (or limited) depending on the ratio of areas of the diaphragm 126 and the valve main body 127*a* which comes into abutment with, and away from, that opening edge of the communication passage 125 on the side of the primary chamber 123 which serves as the valve seat. Therefore, it is possible to supply the ink at a pressure which is stable with little or no pressure fluctuations. In other words, the supply pressure of the ink to be supplied from the ink cartridge 81 is maintained at a predetermined working pressure, but this pressure fluctuations can further be minimized by this pressure regulating valve 121. In addition, since those pulsations, or the like, of the ink which may happen on the side of the ink pack 91 are separated (or isolated) by the valve body 127, they can be absorbed (dumper function).

The maintenance means 24 is made up of a suction means 131 for sucking the ink jet head 41, and a flushing means 132 for receiving the ejection from the ink jet head 41.

The suction means 131 operates to function the suction force of the sucking pump, or the like on the ink jet head 41 through the cap 141 which is arranged to be closely adhered to the nozzle surface of the ink jet head 41. The ink is thus forcibly discharged out of the ejection nozzles 57. The suction means 131 is used to solve or prevent the clogging of the ejection nozzle 57. The cap 141 of the suction means 131 is also used to protect the ink jet head 41. While the ink jet printer 1 is not in operation, the cap 141 is brought into close contact with the nozzle surface of the ink jet head 41, thereby preventing the ejection nozzle 57 from getting dried. The suction means 131 is disposed to face the home position and is therefore so arranged that the cap 141 can be adhered to the ink jet head 41 of the head unit 31 which faces the home position.

The flushing means 132 has a flushing receiving member 151 which receives the ejection from the ink jet head 41. The flushing receiving member 151 is a recessed groove which extends over the head moving region 64 exclusive of the region in which suction means 131 is disposed, and is so arranged that it can receive the ejection from the ink jet head 41 in whichever position the head unit 31 may be located. According to this arrangement, not only the ink droplets which were waste-ejected from the ink jet head 41 but also the ink droplets ejected beyond the edge of the roll paper R can be received by the flushing receiving member 151 (see FIG. 4).

The term "waste ejection" means an ejection of ink whose viscosity has increased (through vaporization, or the like) inside the ejection nozzle 57 of the ink jet head 41 and of ink from all of the ejection nozzles 57 of the ink jet head 41 in order to supply the ejection nozzle 57 with fresh ink of a better condition. By performing the waste ejection, the ink jet head 41 can be maintained in a suitable condition.

The control means 25 is connected to each of the means of the ink jet printer 1 so as to perform an overall control of the ink jet printer 1. The control means 25 is provided with a display (not shown) and various kinds of indicators, or the like, as an interface with the user.

With reference to FIG. 7, a description will now be made about the main control system of the ink jet printer 1. As shown therein, the ink jet printer 1 is made up of: a data input/output section 162 which has a printer interface 161 and inputs print data (imaging data and print control data) and various commands from the host computer and which also outputs various data inside the ink jet printer 1 to the host computer; a detecting section 163 which has an X-axis linear encoder 66, a pressure sensor 115, or the like and which performs various detections; a printing section 164 which has the printing means 21 and the feeding means 22 and which performs printing on the roll paper R; an ink supply section 165 which has the ink supply means 23 and which supplies the ink under pressure; a maintenance section 168 which has the maintenance means 24 and which performs the maintenance of the ink jet head 41; a driving section 166 which has various drivers for driving a head driver 171 for driving the ink jet head 141, a carriage motor driver 172 for driving the carriage motor, a feed motor driver 173 for driving the feed motor, a pump driver 174 for driving the pressurizing pump 112, or the like; and a control section 167 which is connected to each of the above sections and which performs an overall control of the ink jet printer 1.

The control section 167 is made up of: a RAM 181 which has a storing region capable of temporary storing and which is used as a working region for control processing; a ROM 182 which has various storing regions and which stores therein control program and control data (color conversion table, character decoration table, or the like); a CPU 183 which performs computation processing of various data; a peripheral control circuit (P-CON) 184 which has built therein a logic circuit for handling interface signals with peripheral circuits and which has built therein a timer 185 for controlling time; and a bus 186 which interconnects the above.

The RAM 181 has stored therein various data to be used in a method of counting re-pressurizing which is described hereinafter (the data being, e.g., volume of the cartridge case 93 that can be pressurized, ink volume per unit ink droplet, or the like) and is provided with an ink droplet counter (not shown) which counts the number of ink droplets ejected from each of the ejection nozzles 57. The term "re-pressurizing" means to additionally apply a further pressure. The ROM 182 has stored therein a drive control program for controlling the drive control of the pressurizing pump. The computation of re-pressurizing time is also performed in accordance with this drive control program.

The control section 167 performs computation processing of the various data inputted from each section through the P-CON 184 in accordance with the control program, or the like, stored in the ROM 182, and the result of the processing is outputted to each section through the P-CON 184, thereby controlling each section.

For example, the control section 167 has connected thereto a pressure sensor 115 of the pressurizing means 83. Based on the result of detection by the pressure sensor 115, the control section 167 intermittently drives the air supply mechanism 111 (pressurizing pump 112). In this manner, the pressurizing force of the ink cartridge 81, i.e., the supply pressure of the ink to be supplied from the ink cartridge 81 is adjusted to a working pressure (Pmin–Pmax) which is set in advance.

In concrete, the pressure sensor 115 is so set as to detect the lower-limit pressure Pmin of the working pressure. After the pressure sensor 115 detects the lower-limit pressure, the control section 167 is so arranged, inclusive of the initial pressurizing time, that the time for the pressurizing force (ink supply pressure) to reach from the lower-limit pressure Pmin to an upper-limit pressure Pmax of the working pressure by the driving of the pressurizing pump 112, is computed as the re-pressurizing time T (sec). Then, by driving the pressurizing pump 112 (pump driving step) for the computed re-pressurizing time, the pressurizing force of the ink cartridge 81 is adjusted to the working pressure.

The ink jet head 41 has set in advance a compensation pressure range as a pressure of the functional liquid at which the ejection of a predetermined amount (volume) of the functional liquid is compensated. The above working pressure is set so as to satisfy this compensation pressure range.

A description will now be made about the method of computing the time for re-pressurizing. In this embodiment, the re-pressurizing time T is computed as a quotient between A and B, where A is an amount (ml/sec) of air to be supplied by the pressurizing pump 112 per unit time and B is an amount of air (ml) required for the lower-limit pressure Pmin to reach the upper-limit pressure Pmax. The method of computing the re-pressurizing time T has: the air supply amount measuring step for measuring the air supply amount A per unit time; the required air amount computing step for computing the required air amount B; and the re-pressurizing time computing step for computing the time T of re-pressurizing based on the measured air supply amount A per unit time and the required air amount B as computed.

In the air supply amount measuring step, the air supply amount A per unit time is computed by dividing a value "a" (ml) by a value t (sec) at the initial pressurizing by the pressurizing pump 112 to pressurize the cartridge case 93 in the state open to atmosphere to the upper-limit pressure Pmax, where t is the time for the pressurizing force of the cartridge case 93 from the beginning of initial pressurizing to reach the lower-limit pressure Pmin, and "a" is an amount of air supplied by the pressurizing pump 112 during the reaching time t.

The reaching time t is measured by using a timer 185 which is built into the control section 167 (P-CON 184) from the time of starting the driving of the pressurizing pump 112 for initial pressurizing to the time of detecting the lower-limit pressure Pmin.

The air supply amount "a" is computed by Boyle-Charle's law based on the pressurizing volume of the cartridge case 93 at the initial pressurizing time and the pressure change amount of the pressurizing force in the reaching time t. The pressurizing volume is computed by subtracting the ink volume (ml) remnant in the ink pack 91 at the initial pressurizing time from the volume (ml) that can be pressurized in the cartridge case 93 (i.e., the value obtained by subtracting the volume of the ink pack 91 at the time of "ink end" (or ink empty) from the volume of the cartridge case 93). In this case, the ink volume remnant in the ink pack 91 is computed by computation processing based on that ink volume at the time of "ink full" which is set (or stored) in advance, the ink volume per unit ink droplet, and the counter value of the ink counter.

In this embodiment, the air supply amount measuring step is performed each time the ink jet printer 1 is switched on.

The required air amount computation step is the same as the computation of the air supply amount "a." Namely, the pressurizing volume V in the cartridge case 93 at the time of detecting the lower-limit pressure Pmin is computed, and the air amount B required for the lower-limit pressure to reach the upper-limit pressure Pmax at the computed pressurizing volume V is computed by the Boyle-Charles's law.

In the re-pressurizing time computation step, the time T for re-pressurizing is computed by dividing B by A, where B is the required amount of air as computed and A is the amount of air supply per unit time. The amount A of air per unit time supplied in the air supply amount measuring step is stored in the RAM 181. After the initial pressurizing, the re-pressurizing time T is computed by using the amount A of air supply stored in the RAM 181. In this case, the amount A of air supply stored in the RAM 181 is renewed each time the air supply amount measuring step is performed.

In the ink jet head 41, there is set in advance, as a compensation pressure, that ink pressure inside the ink jet head (also referred to as "in-head pressure") which ejects a predetermined amount (volume) of ink droplets. On the other hand, the four colors of inks to be applied to the ink jet printer 1 of this embodiment have different viscous characteristics (viscosities) which are different from one another. It follows that the pressure loss which occurs in the ink passage from the ink cartridge 81 to the ink jet head 41 varies from ink to ink. If the working pressure of the pressurizing pump 112 is made uniform, the pressure of the ink to be supplied to the ink jet head 41 varies, resulting in a variation in the in-head pressure.

As a solution, in the ink jet printer 1 of this embodiment, the following arrangement is made. Namely, based on the compensation pressure that has been set in advance and on the viscosity of each of the inks, the working pressure of the pressurizing pump 112 is set for each of the inks such that the ink pressure at the time of reaching the ink jet head 41 or in-head passage (i.e., head-reaching pressure) becomes the compensation pressure. Based on the set working pressure, the four air supply mechanisms 111 corresponding to the respective inks (respective ink cartridges 81) are independently driven. As a result, the head-reaching pressure of each of the inks becomes the compensation pressure, thereby maintaining the in-head pressure at the compensation pressure.

A description will now be made in detail about the method of setting the working pressure. The RAM 181 in the control section 167 contains therein a working pressure setting table (or a formula) which correlates the pressure loss in the ink passage (pressure difference between the average of the working pressure and the compensation pressure) with the ink viscosity. In this case, the relationship between the pressure loss in the ink passage and the ink viscosity is determined based on the empirical results obtained by causing to flow inks of different viscosities through the actual ink passages. According to this arrangement, as the pressure loss in the ink passage, there can be obtained values taking into consideration the length of the ink passage, inner diameter of the liquid supply tube 84, and pressure loss due to the pressure regulating valve 121 and couplings, or the like. It is also possible to obtain by calculation the pressure loss based on the tube length of the liquid supply tube 84, tube diameter, tube bending, couplings, smoothness inside the tube, ink viscosity, or the like.

The ink cartridge 81 is also provided with a memory section (made up, e.g., of EPROM) in which is stored various ink information inclusive of the ink viscosity, ink color, or the like. When ink cartridges 81 are mounted on a corresponding cartridge mounting portion 101, the ink viscosity is read out from the memory portion of the ink cartridge 81 by means of the control section and is inputted. Once the ink viscosity is inputted, the control section 167 refers to the working pressure setting table to thereby obtain the pressure loss in the ink passage corresponding to the inputted ink viscosity. Thereafter, the control section 167 sets the working pressure based on the obtained pressure loss in the ink passage and the set compensation pressure. In other words, by adding the obtained pressure loss in the ink passage to the compensation pressure, there can be obtained an average value of the working pressure. The result thus obtained is added to or subtracted from the predetermined pressure amount to thereby determine the upper-limit pressure Pmax of the working pressure and the lower-limit pressure Pmin of the working pressure, and the detection pressure of the pressure sensor is set to Pmin.

In this manner, according to this embodiment, the pressure loss in the ink passage is obtained from the working pressure table in accordance with each viscosity of the four colors of inks, and the working pressure of the pressurizing pump 112 corresponding to each of the inks is independently set based on the pressure loss. Therefore, the head-reaching pressure can be made to be the compensating pressure. As a result, the in-head pressure of each ink can be maintained at the compensating pressure, with the result that the ink droplets can be ejected from the ink jet head 41 at a higher accuracy.

In place of the above-referenced working pressure setting table, there may be used a table in which the average of the working pressure to become the compensation pressure having set therein the head reaching pressure and the ink viscosity are correlated with each other. In this case, since a compensation pressure which is different from ink to ink will be set, it is preferable that a plurality of tables are prepared to cope with a plurality of compensation pressures.

It has been explained that the compensation pressure of the ink is set in advance. However, in case there exists a co-relationship between the viscosity of the ink and the compensation pressure, there may be stored in the RAM 181 a compensation pressure setting table co-relating the viscosity of the ink and the compensation pressure. Based on the input of the viscosity of each ink, the compensation pressure may thus be set from ink to ink.

In this embodiment, an arrangement is made that, when the ink cartridge 81 is mounted on the cartridge mounting portion 101, the viscosity of the ink is read out from the memory of the ink cartridge 81 to thereby input it. Alternatively, it may be so arranged that the user directly inputs the ink viscosity.

A description will now be made about a second embodiment of the invention. The liquid droplet ejection apparatus is built into a so-called flat panel manufacturing line. A functional liquid of a functional material having dissolved therein a solvent is introduced into the functional liquid droplet ejection head. By using the liquid droplet ejection method (to which the ink jet method is applied), there is formed a coloring layer of a color filter in a liquid crystal display device made up of three colors of red (R), green (G) and blue (B), a light-emitting element forming each pixel of an organic electro-luminescence device, or the like.

Figure 9:
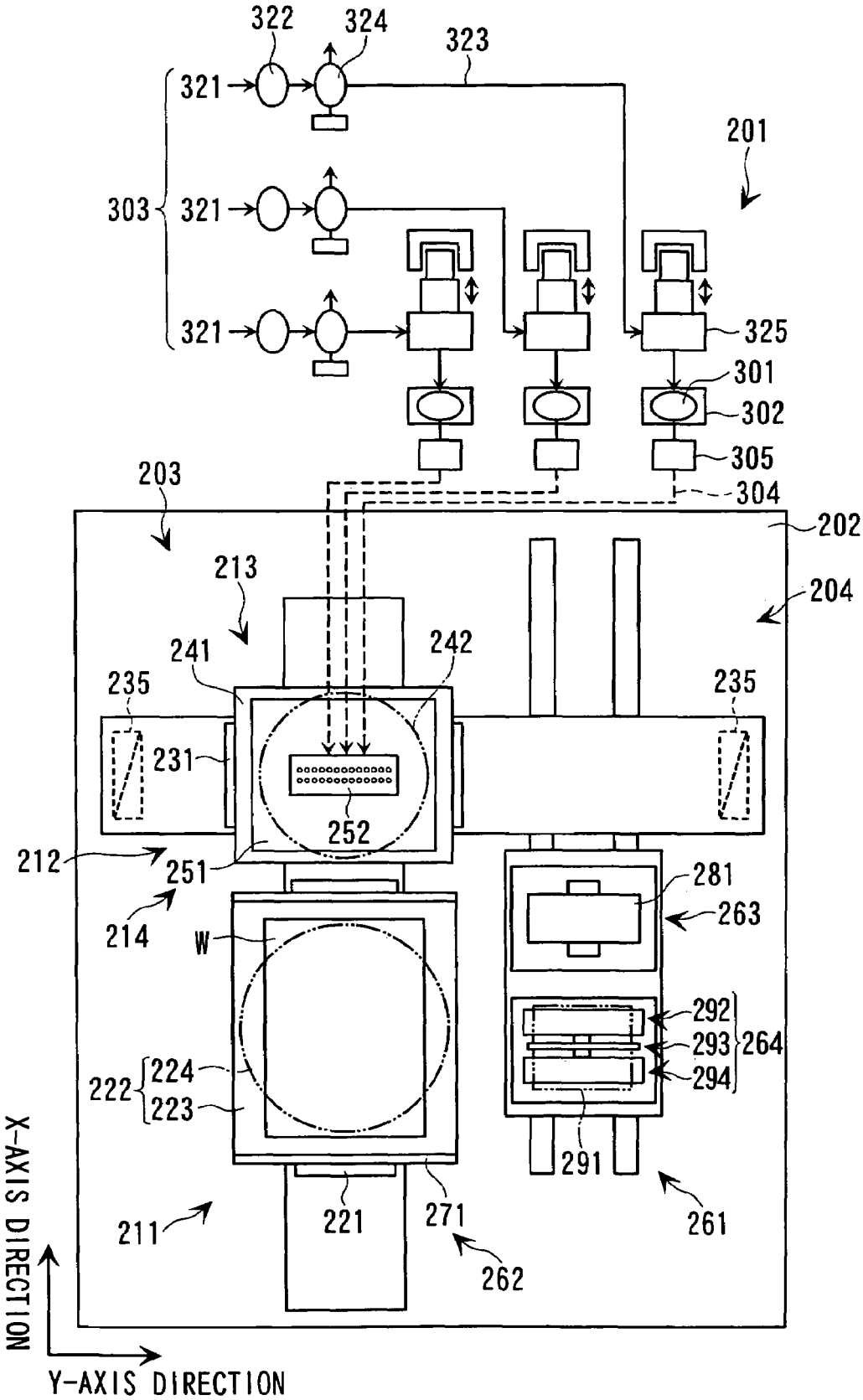
FIG. 9 is a schematic plan view of a liquid droplet ejection apparatus according to a second embodiment of the invention.

As shown in FIG. 9, the liquid droplet ejection apparatus 201 is made up of: an apparatus base 202; an imaging apparatus 203 which is mounted on the entire area of the apparatus base 202 and which has a functional liquid droplet ejection head 252; a head maintenance apparatus 204 which is disposed in parallel with the imaging apparatus 203 on the apparatus base 202; a functional liquid supply apparatus 205 (FIG. 10) which supplies the functional liquid droplet ejection head 252 with the functional liquid; and a control apparatus 206 (not shown) which controls each of the apparatuses. In the liquid droplet ejection apparatus 201, the imaging apparatus 203 performs imaging work, based on the control by the control apparatus 206, on the workpiece which is introduced thereinto by a workpiece transfer robot (not shown). The head maintenance apparatus 204 performs maintenance work as required onto the functional liquid droplet ejection head 252.

The imaging apparatus 203 is made up of: an X-axis table 211 which is elongated in the main scanning direction (X-axis direction); a Y-axis table 212 which crosses the X-axis table at right angles; a main carriage 213 which is mounted on the Y-axis table in a movable manner; and a head unit 214 which is supported by the main carriage 213 and on which a plurality of functional liquid droplet ejection heads 252 are mounted.

The X-axis table 211 is made up of an X-axis slider 221 to be driven by an X-axis motor (not shown) which constitutes a driving system in the X-axis direction, and a set table 222 on which is set the workpiece W and which is mounted on the X-axis slider 221 in a movable manner. The set table 222 is made up of: a suction table 223 which sucks for positioning the workpiece W; and a θ-table 224 which corrects the position of the workpiece W as set on the suction table 223 in the θ direction. The apparatus base 202 is provided with an X-axis linear sensor 225 (FIG. 10) for grasping the moving position of the set table 222 which moves in the X-axis direction.

The Y-axis table 212 has substantially the same construction as the X-axis table 211. The Y-axis table 212 has a Y-axis slider 231 driven by a Y-axis motor (not shown) which constitutes the driving system in the Y-axis direction, and has the main carriage 213 in a manner movable in the Y-axis direction. In a manner to lie in parallel with the Y-axis table 212, there is provided a Y-axis linear sensor 232 (FIG. 10) for grasping the moving position of the head unit 214 which moves in the Y-axis direction. The Y-axis table 212 is disposed in a manner to bridge over the X-axis table 211 and the head maintenance apparatus 204 mounted on the apparatus base 202 through right and left supporting columns 235 which are vertically disposed on the apparatus base 202. The imaging area in which the X-axis table 211 and the Y-axis table 212 cross each other is the area to perform therein the imaging on the workpiece W, and the area in which the Y-axis table 212 and the head maintenance apparatus 204 crosses is the maintenance area to perform therein the maintenance work on the functional liquid droplet ejection head 252.

The main carriage 213 is made up of: a carriage main body 241 which supports the head unit 214; a θ-rotation mechanism 242 which performs positional correction in the θ direction of the head unit 214; and a suspension member (not shown) of substantially I-shape which supports the carriage main body 241 (head unit 214) on the Y-axis table 212 through the θ-rotation mechanism 242.

The head unit 214 is made up by mounting the functional liquid droplet ejection head 252 on the head plate 251 through a supporting member (not shown). The functional liquid droplet ejection head 252 is constituted in a manner similar to the above-referenced ink jet head 41. Therefore, description thereabout is omitted.

A description will now be made about a series of operations of the imaging apparatus 203 at the time of imaging processing. First, the positional correction of the head unit 214 is performed through the θ-rotation mechanism 242, and also the positional correction of the workpiece W set in position on the set table 222 is performed. Then, by driving the X-axis table 211, the workpiece W is moved back and forth in the main scanning direction (X-axis direction). In a manner synchronized with the forward movement of the workpiece W, the plurality of functional liquid droplet ejection heads 252 are driven to thereby perform selective ejection operation of the functional liquid droplets on the workpiece W. Once the forward movement of the workpiece W is finished, the Y-axis table 212 is driven to thereby move the head unit 214 in the sub-scanning direction (Y-axis direction) Then, the backward movement of the workpiece W and the driving of the functional liquid droplet ejection head 252 are performed again. In this manner, by repeating the movement of the workpiece W in the X-axis direction and the driving for ejection of the functional liquid droplet ejection head 252 synchronized therewith, as well as the movement (sub-scanning) of the head unit 214 in the Y-axis direction, a predetermined imaging pattern can be formed (drawn or imaged) on the workpiece W.

The head maintenance apparatus 204 is made up of a moving table 261 which is mounted on the apparatus base 202, a flushing unit 263, and a wiping unit 264. The moving table 261 is constituted into a construction capable of moving in the X-axis direction. The suction unit 263 and the wiping unit 264 are disposed on the moving table 261 side by side in the X-axis direction. At the time of maintenance of the functional liquid droplet ejection head 252, the moving table 261 is driven so that the suction unit 263 and the wiping unit 264 face the maintenance area where required.

The flushing unit 262 operates to receive, in the course of a series of imaging processing on a single piece of workpiece W, the functional liquid to be waste-ejected (flushed) from all of the functional liquid droplet ejection heads 252 of the head unit 214 and the functional liquid which is ejected beyond the workpiece W during the imaging processing. The flushing unit 262 has a pair of imaging flushing boxes 271 which are provided so as to lie along a pair of sides (peripheral edge) parallel in the Y-axis direction of the suction table 223. Therefore, when the workpiece W is moved back and forth in the X-axis direction through the suction table 223, all of the functional liquid droplet ejection heads 252 of the head unit 214 can be sequentially made to face the imaging flushing boxes 271 even in case where, as a result of one main scanning, the head unit 214 is right before facing the workpiece W or right after leaving the workpiece W. As a result, the functional liquid subjected to waste-flushing right before and right after the imaging operation to the workpiece W can be appropriately received.

The suction unit 263 corresponds to the above-referenced suction means 131, and is provided with a cap 281 which comes into close contact with the nozzle surface of the functional liquid droplet ejection head 252, and a single suction pump that can suck the functional liquid droplet ejection head 252 through the cap 281.

The wiping unit 264 wipes out, with wiping sheet 291 sprayed with a cleaning liquid, the stains adhered to the nozzle surface of the functional liquid droplet ejection head 252, and is made up of: a take-up unit 292 which takes up the rolled wiping sheet 291 while paying it out; a cleaning liquid supply unit 293 which sprays the paid out wiping sheet 291 with the cleaning liquid; and a wiping unit 294 which wipes out the nozzle surface with the wiping sheet sprayed with the cleaning liquid.

The functional liquid supply apparatus 205 is made up of: three functional liquid tanks 301 corresponding to the three colors (R, G, B) of functional liquids; a tank holder 302 which contains the three functional liquid tanks 301; a pressurizing means 303 which supplies under pressure the functional liquids in the functional liquid tanks 301 to the functional liquid droplet ejection heads 252; a plurality of (three) liquid supply tubes 304 which connect the three functional liquid tanks 301 with the functional liquid droplet ejection heads 252; and pressure regulating valves 305 which are constituted in a similar manner as those of the ink jet printer 1 and which are interposed in each of the liquid supply tubes 304.

The functional liquid supply apparatus 205 is constituted substantially in the same manner as the above-referenced ink supply means, and a cartridge type is employed as the functional liquid tank 301. The tank holder 302 is provided with a functional liquid containing portion (not shown) which contains therein each of the functional liquid tanks 301. The functional liquid containing portion has disposed therein a connection adapter (not shown) which connects the functional liquid tank 301 and the air piping 323. The pressurizing means 303 has an air supply mechanism 321 which supplies each of the functional liquid tanks 301 with air through the adapter. When a single pressurizing pump 322 constituting the air supply mechanism 321 is driven, each of the functional liquid tanks 301 is supplied with air through the air piping 323. In this case, the air piping 323 has interposed therein a regulator 324 with a solenoid and a pressure sensor 325 so as to maintain the inside of the air piping 323 to a predetermined working pressure.

The control apparatus 206 is constituted by a personal computer, or the like, and has an input means (keyboard, or the like; not shown) for performing data input and various setting; a display (not shown) for visually confirming the state of inputted data, various setting, or the like.

Figure 10:
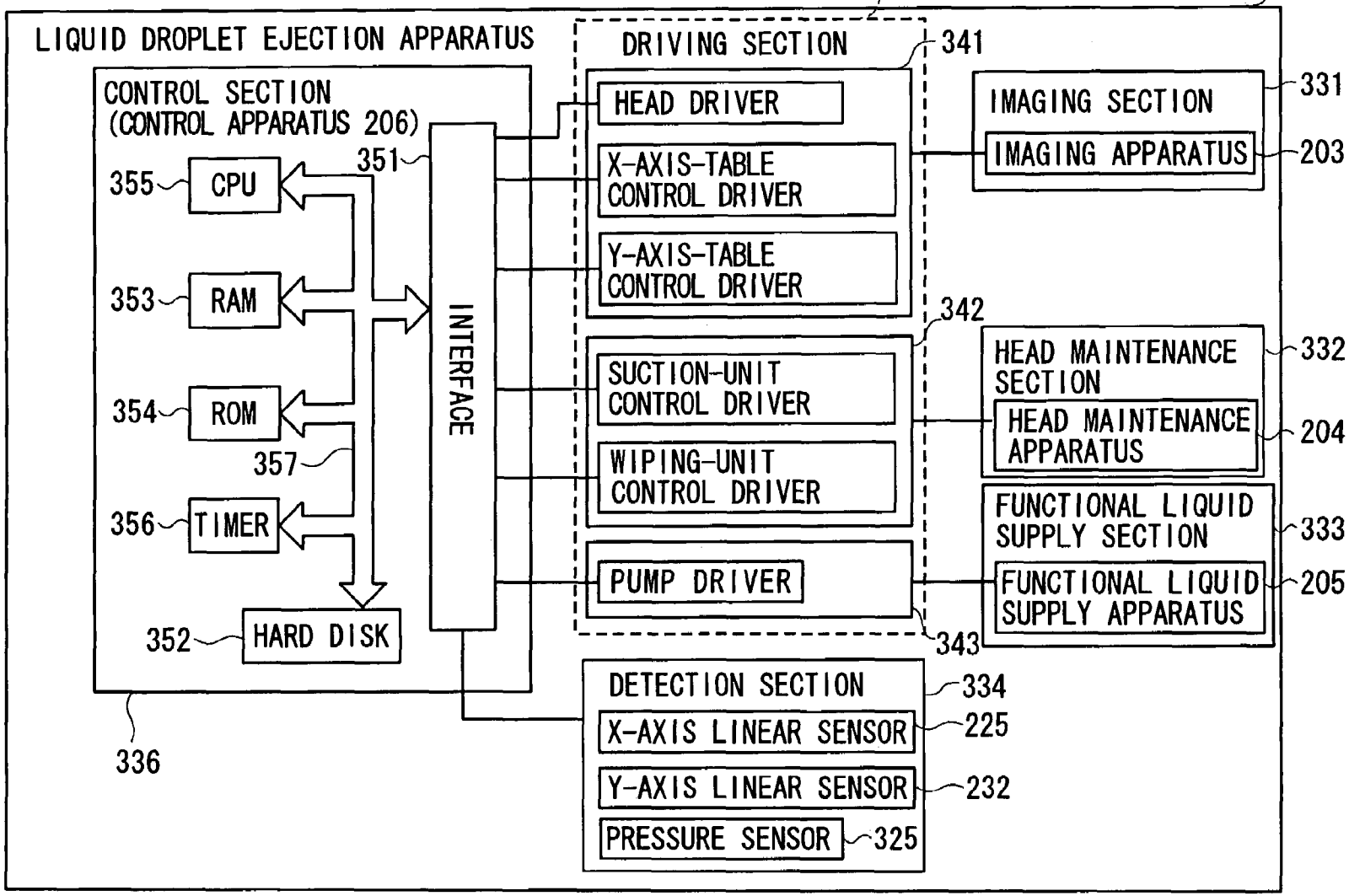
FIG. 10 is a block diagram explaining the main control system of the liquid droplet ejection apparatus.

With reference to FIG. 10, a description will now be made about the main control system of the liquid droplet ejection apparatus 201. The liquid droplet ejection apparatus 201 is made up of: an imaging section 331 having an imaging apparatus 203; a head maintenance section 332 having a head maintenance apparatus 204; a functional liquid supply section 333 having a functional liquid supply apparatus 205; a detection section 334 having various sensors for the head maintenance apparatus 204 and the functional liquid supply apparatus 205, thereby performing various detections; a driving section 335 having various drivers for driving various apparatuses (e.g., drivers 341 for driving the imaging apparatus 203, drivers 342 for driving the head maintenance apparatus 204, a driver 343 for driving the functional liquid supply apparatus 205, or the like); and a control section 336 (control apparatus 206) which is connected to each section and performs an overall control of the liquid droplet ejection apparatus 201.

The control section 336 has substantially the same construction as the above-referenced control section 25 of the ink jet printer 1, except that the following are provided, i.e.: an interface 351 for connecting the imaging apparatus 203, the head maintenance apparatus 204, or the like; and a hard disk 352 which stores therein various data, or the like, from the imaging apparatus 203, the head maintenance apparatus 204, and the functional liquid supply apparatus 205 and which also stores therein program, or the like for processing various data. The control section 336 is provided with a RAM 353, a ROM 354, a CPU 355, a timer 356 and an internal bus 357.

The liquid droplet ejection apparatus 201 in this embodiment is controlled in the same manner as the above-referenced ink jet printer 1. Namely, based on the viscosity of each of the three colors of functional liquids, the working pressure of the pressurizing pump 322 is arranged to be independently set. Therefore, the head-reaching pressure of the functional liquid is made to be the compensating pressure, and the in-head pressure of each ink can be maintained at the compensating pressure. As a result, the functional liquid droplets can be ejected from the functional liquid droplet ejection head 252 at a higher accuracy. The manufacturing yield can thus be improved and the highly reliable products can be manufactured.

Next, a description will be made about a construction and a method of manufacturing, for example, a color filter, a liquid-crystal display (LCD), an organic EL (electro-luminescence) device, a plasma display panel (PDP device), an electron emission device (FED (field emission display) and SED (surface-conduction electron-emitter display)), and an active matrix substrate which is formed in the above-referenced display devices, as an electro-optical device (flat panel display) manufactured by the use of the liquid droplet ejection apparatus 201 of the embodiment. Note that the active matrix substrate refers to a substrate having a thin film transistor, a source line electrically connected to the thin film transistor, and a data line formed therein.

Figure 11:
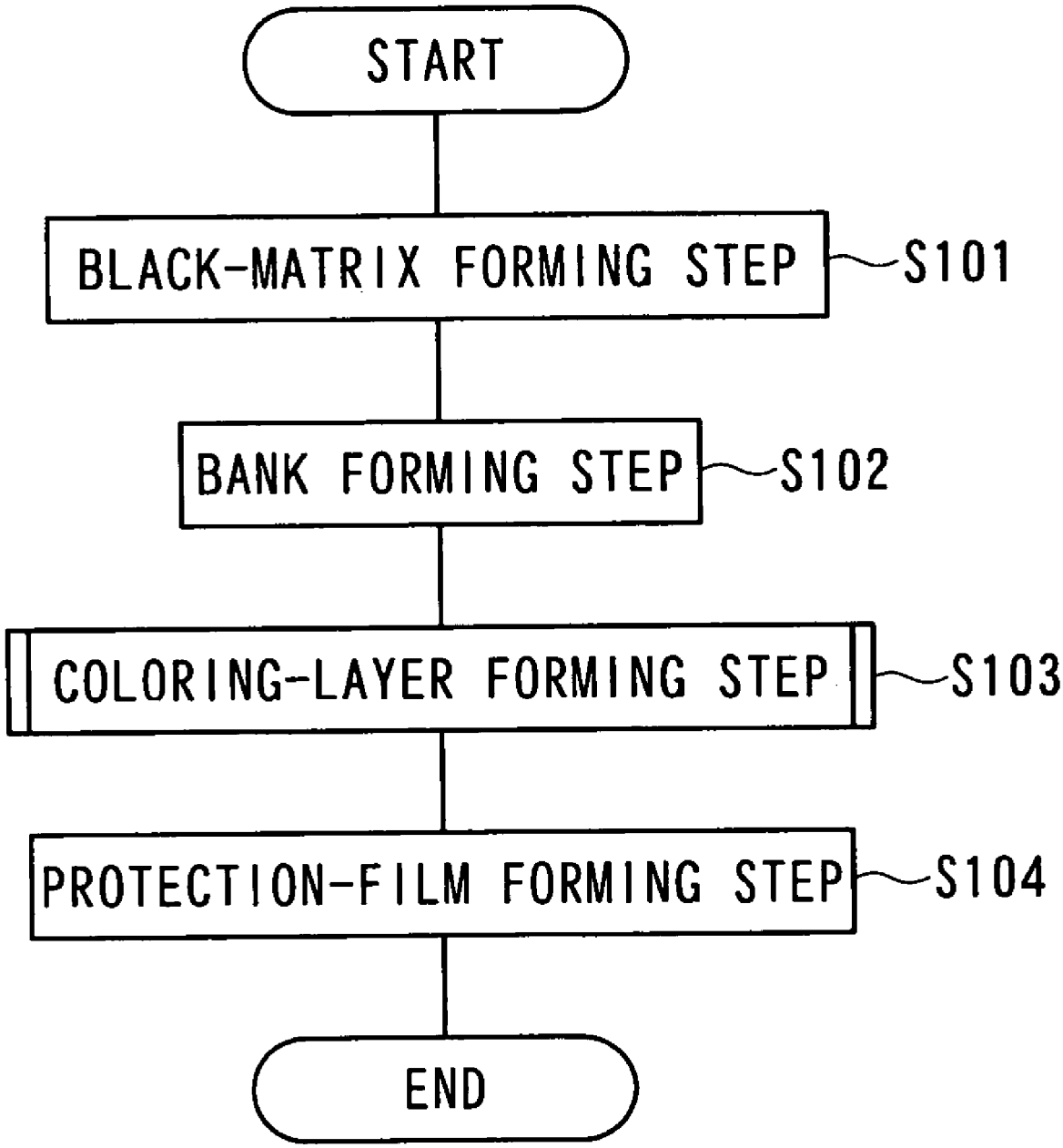
FIG. 11 is a flow chart explaining the steps of manufacturing a color filter.

To begin with, a description will be made about a method of manufacturing a color filter to be incorporated in a liquid-crystal display-device, an organic EL device, or the like. FIG. 11 is a flow chart showing a process of manufacturing a color filter, and FIGS. 12A-12E are schematic cross sections of a color filter 600 (filter substrate 600A) of the embodiment as shown in the order of the manufacturing process thereof.

Figure 12A:
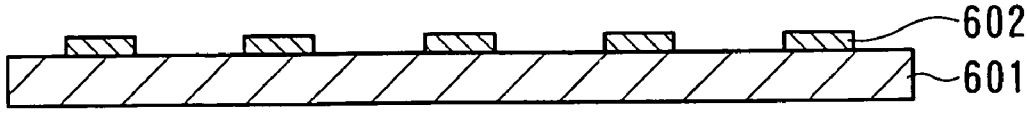
FIGS. 12A through 12E are schematic cross sections of the color filter as shown in the order of manufacturing the same.

First, in a black-matrix forming step (S101), a black matrix 602 is formed on a substrate (W) 601 as shown in FIG. 12A. The black matrix 602 is made of a chromium metal, a laminated body of a chromium metal and a chromium oxide, a resin black, or the like. A sputtering method, a vapor deposition method, or the like can be used to form the black matrix 602 made of a metallic thin film. Furthermore, a gravure printing method, a photo-resist method, a thermal transfer method, or the like can be used to form the black matrix 602 made of a resin thin film.

Figure 12B:
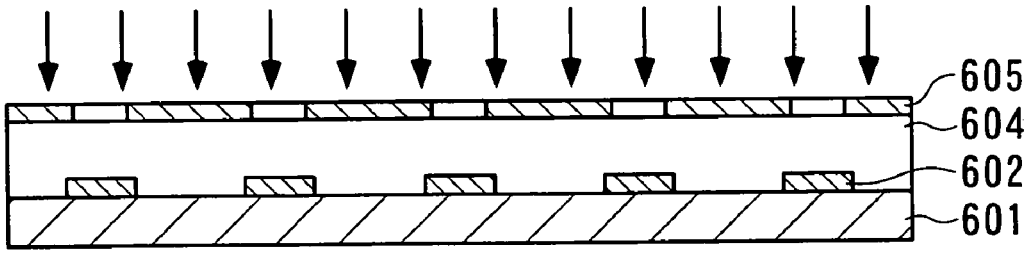

Subsequently, in a bank forming step (S102), a bank 603 is formed so as to superpose on the black matrix 602. In other words, as shown in FIG. 12B, a resist layer 604 made of a negative transparent photosensitive resin is formed to cover the substrate 601 and the black matrix 602. Then, an exposure process is performed on the top surface of the resist layer in a state of being covered by a mask film 605 formed in a matrix pattern.

Figure 12C:
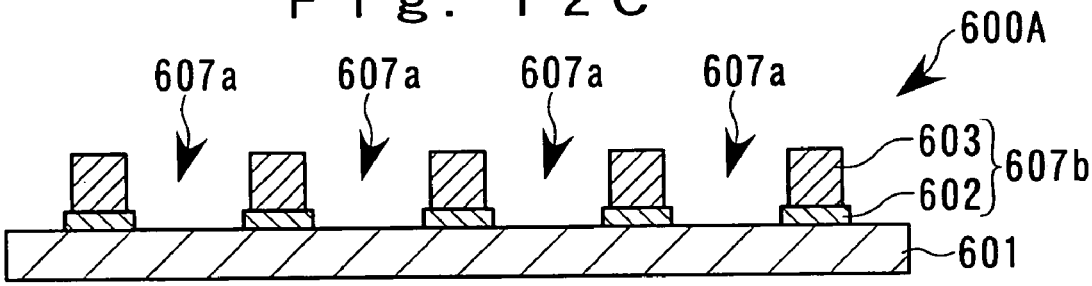

Moreover, as shown in FIG. 12C, an unexposed portion of the resist layer 604 is etched to pattern the resist layer 604, thereby forming the bank 603. Note that, when the black matrix is formed of a resin black, it is possible that the black matrix serves also as the bank.

The bank 603 and the black matrix 602 thereunder serve as a partition wall portion 607*b* for partitioning respective pixel regions 607*a* and define shooting positions of functional liquid droplets when coloring layers (film-deposited portions) 608R, 608G, and 608B are formed with the functional liquid droplet ejection heads 252 in a coloring-layer forming step as described later.

According to the black-matrix forming step and the bank forming step as described above, the filter substrate 600A can be obtained.

Note that, in the embodiment, a resin material is used as a material of the bank 603 so as to have a lyophobic (hydrophobic) surface of a coating film. The front surface of the substrate (glass substrate) 601 is lyophilic (hydrophilic), thereby enhancing the positional accuracy for shooting liquid droplets into the respective pixel regions 607*a* surrounded by the banks 603 (partition wall portions 607*b*) in a coloring-layer forming step as described later.

Figure 12D:
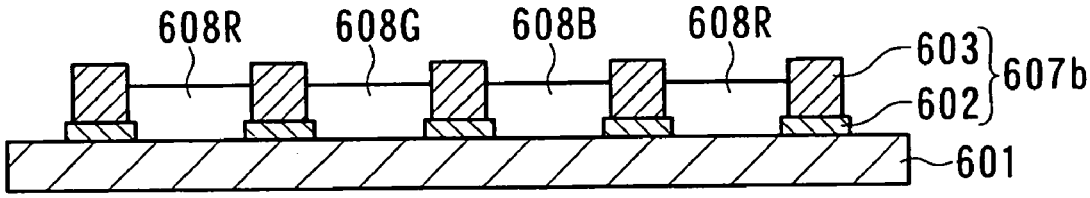

Next, in the coloring-layer forming step (S103), functional liquid droplets are ejected by the functional liquid droplet ejection heads 252 and shot into the respective pixel regions 607*a* surrounded by the partition wall portions 607*b* as shown in FIG. 12D. In this case, a functional liquid (filter material) of three colors of R (red), G (green), and B (blue) is introduced by the functional liquid droplet ejection heads 252 to eject functional liquid droplets. Note that examples of arrangement patterns for the three colors of R, G, and B include a strip arrangement, a mosaic arrangement, a delta arrangement, or the like.

Figure 12E:
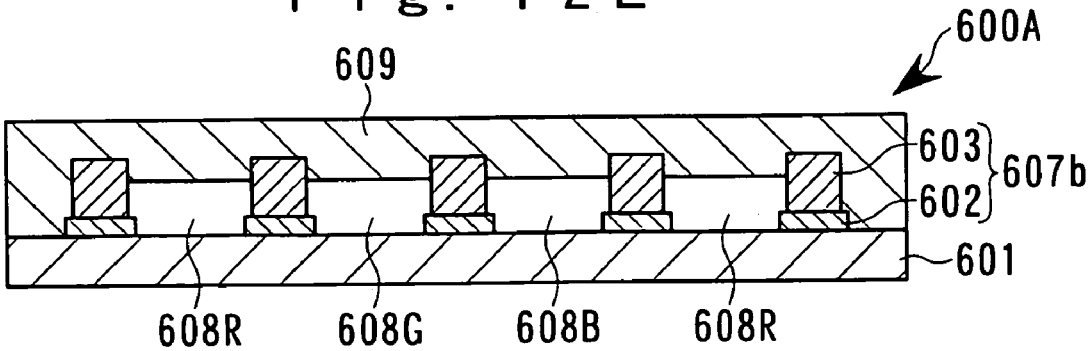

Subsequently, the functional liquids are subjected to drying treatment (e.g., thermal treatment) so as to be fixed, and the coloring layers 608R, 608G, and 608B of the three colors are formed. After the coloring layers of 608R, 608G, and 608B are formed, the step is moved to a protection-film forming step (S104) where a protection film 609 is formed to cover the top surfaces of the substrate 601, the partition wall portions 607*b*, and the coloring layers 608R, 608G, and 608B as shown in FIG. 12E.

In other words, after a coating liquid for a protection film is ejected on the whole surface of the substrate 601 having the coloring layers 608R, 608G, 608B formed thereon, the whole surface is subjected to drying treatment to thereby form the protection film 609.

After the protection film 609 is formed, the step is moved to the next step of forming ITO (Indium Tin Oxide) as a transparent electrode in manufacturing the color filter 600.

Figure 13:
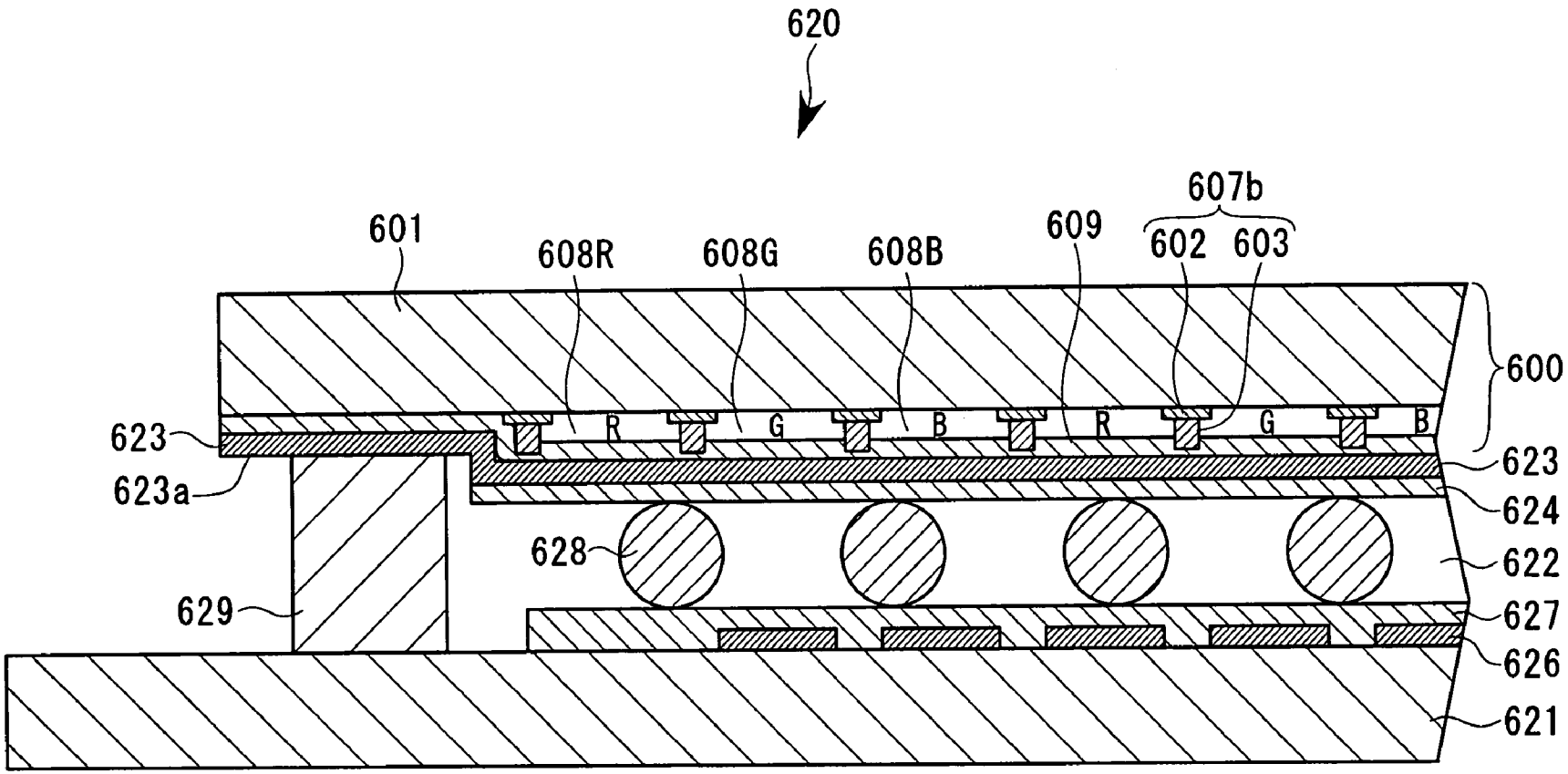
FIG. 13 is a cross section of an essential part showing a schematic configuration of a liquid crystal device using the color filter to which the invention is applied.

FIG. 13 is a cross section of an essential part showing a schematic configuration of a passive matrix liquid crystal display (liquid crystal device) as an example of an LCD using the color filter 600 as described above. It is made possible to obtain a transmission liquid crystal display as a final product by mounting additional elements such as a liquid crystal driving IC, a backlight, a supporting body on a liquid crystal device 620. Note that this color filter 600 is identical with that shown in FIGS. 12A-12E. Thus, the corresponding portions are denoted by the same reference numerals, but the description thereof will be omitted.

The liquid display device 620 is roughly composed of the color filter 600, a counter substrate 621 made of a glass substrate or the like, and a liquid crystal layer 622 which is made of an STN (Super Twisted Nematic) liquid crystal composition and held between the color filter and the counter substrate. The color filter 600 is arranged on the upper side of the figure (on the observer's side).

Note that, although not shown in the figure, polarizers are each disposed on the outside surfaces of the counter substrate 621 and the color filter 600 (the surfaces opposite to the liquid crystal layer 622 side), and the backlight is disposed on the outside of the polarizer arranged on the counter substrate 621 side.

On the protection film 609 of the color filter 600 (liquid crystal layer side), a plurality of elongated first electrodes 623 in a strip shape are formed in the longitudinal direction at predetermined intervals as shown in FIG. 13. A first alignment layer 624 is formed to cover the surfaces opposite to the color filter 600 side of the first electrodes 623.

On the other hand, on the surface of the counter substrate 621 opposite to the color filter 600, a plurality of elongated second electrodes 626 in a strip shape are formed in the direction orthogonal to the first electrodes 623 of the color filter 600 at predetermined intervals. A second alignment layer 627 is formed to cover the surfaces of the liquid crystal layer 622 side of the second electrodes 626. The first electrodes 623 and the second electrodes 626 are made of a transparent conductive material such as ITO.

Spacers 628 provided in the liquid crystal layer 622 are members for holding a constant thickness (cell gap) of the liquid crystal layer 622. Furthermore, a sealant 629 is a member for preventing a liquid crystal composition of the liquid crystal layer 622 from leaking outside. Note that one end portion of each of the first electrode 623 extends to the outside of the sealant 629 as a routing wire 623*a*.

Areas where the first electrodes 623 and the second electrodes 626 cross each other are pixels at which the coloring layers 608R, 608G, and 608B of the color filter 600 are to be positioned.

According to the conventional manufacturing process, the color filter 600 side is formed in such a way that the first electrodes 623 are patterned and the first alignment layer 624 is coated on the color filter 600, while the counter substrate 621 side is formed in such a way that the second electrodes 626 are patterned and the second alignment layer 627 is coated on the counter substrate 621. Subsequently, the spacers 628 and the sealant 629 are formed on the counter substrate 621 side and bonded to the color filter 600 side. Next, after liquid crystal constituting the liquid crystal layer 622 is filled in from an inlet of the sealant 629, the inlet is closed. Then, both polarizers and the backlight are deposited.

According to the liquid droplet ejection apparatus 201 of the embodiment, it is, for example, possible to coat a spacer material (functional liquid) constituting the cell gap and evenly coat liquid crystal (functional liquid) in the region surrounded by the sealant 629 before the color filter 600 side is bonded to the counter substrate 621 side. It is further possible to perform printing of the sealant 629 with the functional liquid droplet ejection heads 252. In addition, it is possible to coat the first and second alignment layers 624 and 627 with the functional liquid droplet ejection heads 252.

Figure 14:
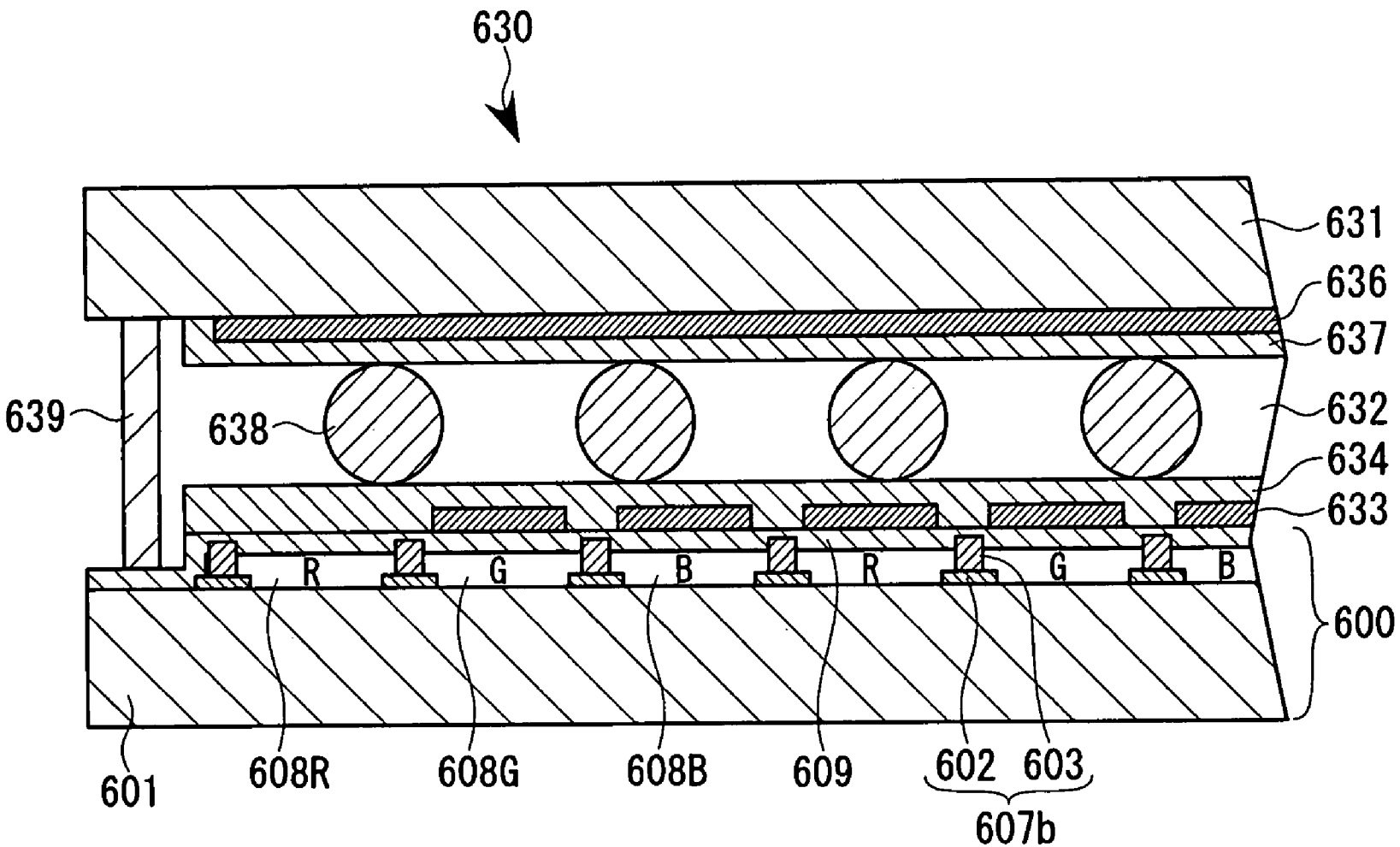
FIG. 14 is a cross section of an essential part showing a schematic configuration of a liquid crystal device as a second example using the color filter to which the invention is applied.

FIG. 14 is a cross section of an essential part showing a schematic configuration of a liquid crystal device, as a second example, using the color filter 600 manufactured in the embodiment.

The liquid crystal device 630 is greatly different from the liquid crystal device 620 in that the color filter 600 is arranged on the lower side of the figure (the side opposite to the observer's side).

The liquid display device 630 is roughly composed of the color filter 600, a counter substrate 631 made of a glass substrate or the like, and a liquid crystal layer 632 made of an STN liquid crystal composition and held between the color filter and the counter substrate. Note that, although not shown in the figure, polarizers or the like are each disposed on the outside surfaces of the counter substrate 631 and the color filter 600.

On the protection film 609 of the color filter 600 (liquid crystal layer 632 side), a plurality of elongated first electrodes 633 in a strip shape extending in the direction orthogonal to the figure are formed at predetermined intervals. A first alignment layer 634 is formed to cover the surfaces on the liquid crystal layer 632 side of the first electrodes 633.

On the surface of the counter substrate 631 opposite to the color filter 600, a plurality of elongated second electrodes 636 in a strip shape extending in the direction orthogonal to the first electrodes 633 on the color filter 600 side are formed at predetermined intervals. A second alignment layer 637 is formed to cover the surfaces of the liquid crystal layer 632 side of the second electrodes 636.

The liquid crystal layer 632 has provided therein spacers 638 for holding a constant thickness of the liquid crystal layer 632 and a sealant 639 for preventing a liquid crystal composition in the liquid crystal layer 632 from leaking outside.

In the same manner as that of the liquid crystal device 620, areas where the first electrodes 633 and the second electrodes 636 cross each other are pixels at which the coloring layers 608R, 608G, and 608B of the color filter 600 are to be positioned.

Figure 15:
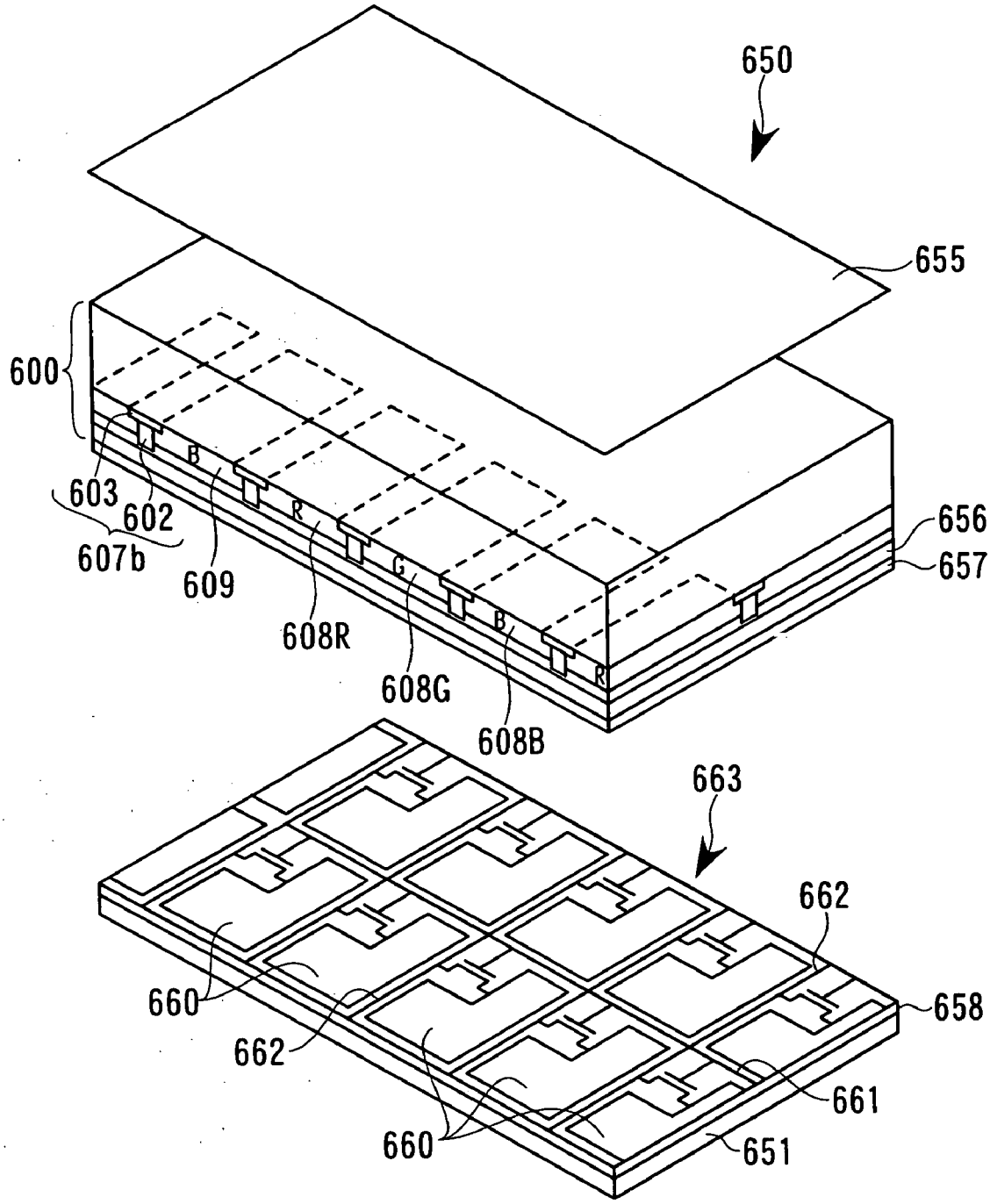
FIG. 15 is a cross section of an essential part showing a schematic configuration of a liquid crystal device as a third example using the color filter to which the invention is applied.

FIG. 15 shows a third example in which a liquid crystal device is constituted by the use of the color filter 600 to which the invention is applied and is an exploded perspective view showing a schematic configuration of a transmission TFT (Thin Film Transistor) liquid crystal device.

In the liquid crystal device 650, the color filter 600 is arranged on the upper side of the figure (on the observer's side).

The liquid crystal device 650 is roughly composed of the color filter 600, a counter substrate 651 disposed so as to oppose the color filter, a liquid crystal layer held between the color filter and the counter substrate (not shown), a polarizer 655 disposed on the top surface side of the color filter 600 (observer's side), and a polarizer (not shown) disposed on the bottom surface side of the counter substrate 651.

On the front surface of the protection film 609 of the color filter 600 (the surface on the counter substrate 651 side) is formed electrodes 656 for driving liquid crystal. The electrodes 656 are made of a transparent conductive material such as ITO and serves as the whole electrode covering the whole region in which the later-mentioned pixel electrodes 660 are formed. Furthermore, an alignment layer 657 is disposed in such a way as to cover the surfaces of the electrodes 556 opposite to the pixel electrodes 660 side.

The counter substrate 651 has an insulating layer 658 formed on the surface thereof opposite to the color filter 600. On the insulating layer 658 are formed scanning lines 661 and signal lines 662 in such a way that they directly cross each other. In regions surrounded by the scanning lines 661 and the signal lines 662 are formed pixel electrodes 660. Note that, although an alignment layer is disposed on the pixel electrodes 660 in an actual liquid crystal devices, it is omitted in the figure.

Furthermore, in the portion surrounded by a notch of the pixel electrode 660, each of the scanning lines 661, and each of the signal lines 662 is incorporated a thin film transistor 663 including a source electrode, a drain electrode, a semiconductor, and a gate electrode. It is possible, by applying signals to the scanning lines 661 and the signal lines 662, to turn on or off the thin film transistor 663 so as to perform an energizing control on the pixel electrodes 660.

Note that, although the liquid crystal devices 620, 630, and 650 of the respective examples as described above are of a transmission type, it is also possible to employ a liquid crystal device of a reflective type or a semi-transparent reflective type by providing a reflective layer or a semi-transparent reflective layer therein.

Figure 16:
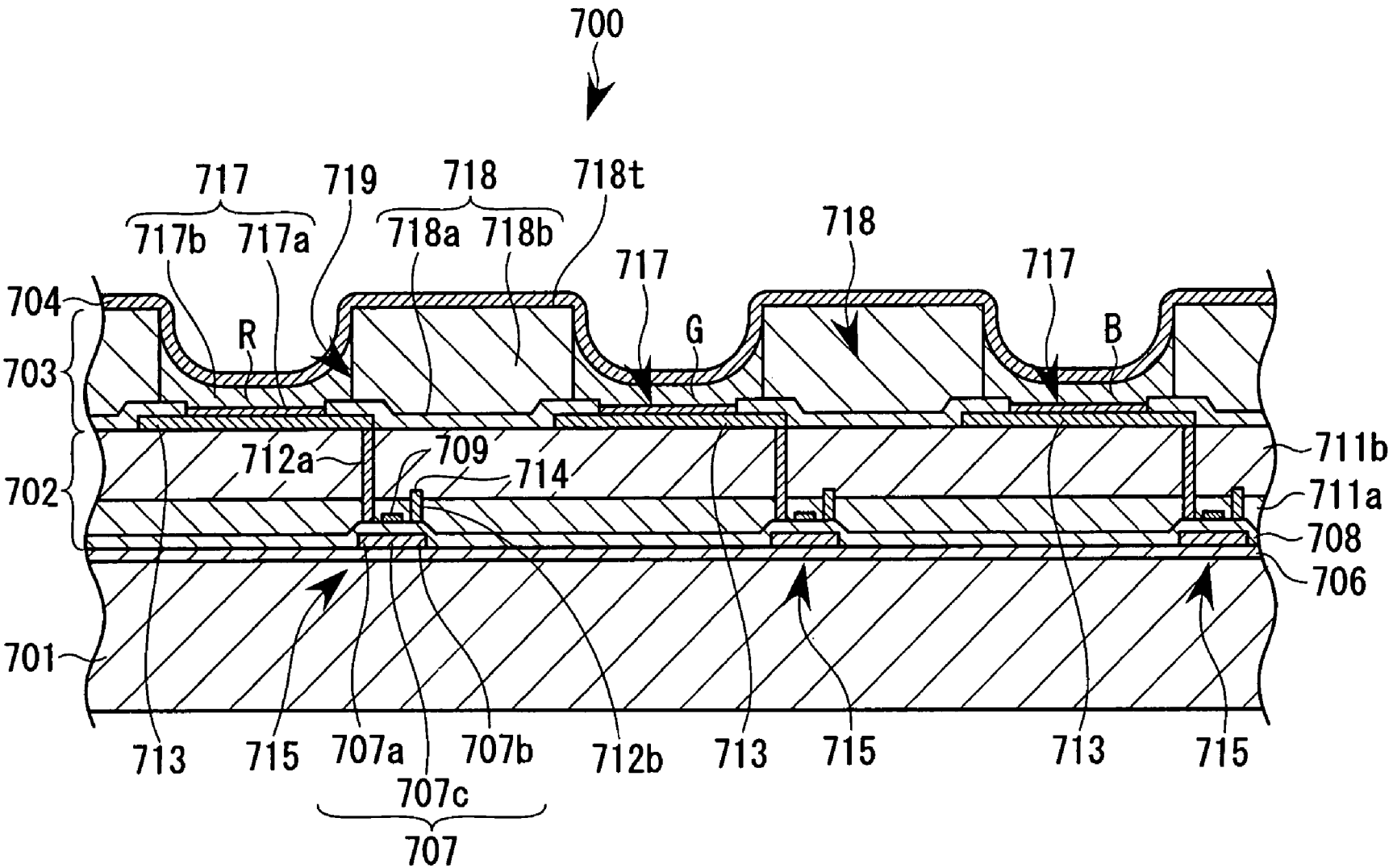
FIG. 16 is a cross section of an essential part of a display device as an organic EL device.

Next, FIG. 16 is a cross section of an essential part of a display region of an organic EL device (hereinafter, simply referred to as a display device 700).

The display device 700 has a rough configuration in which a circuit element portion 702, a light-emitting element portion 703, and a cathode 704 are laminated on a substrate (W) 701.

In the display device 700, light emitted from the light-emitting element portion 703 to the substrate 701 side passes through the circuit element portion 702 and the substrate 701 and is emitted to the observer's side, while light emitted from the light-emitting element portion 703 to the side opposite to the substrate 701 is reflected by the cathode 704, then passes through the circuit element portion 702 and the substrate 701, and is emitted to the observer's side.

The circuit element portion 702 and the substrate 701 have a base protection film 706 made of a silicone oxide film formed therebetween. The base protection film 706 (light-emitting element portion 703 side) has island-shaped semiconductor films 707 made of polycrystalline silicone formed thereon. In the left and right regions of the semiconductor films 707, highly concentrated cations are implanted so as to form a source region 707*a* and a drain region 707*b*, respectively. The central portion where no cations are implanted serves as a channel region 707*c*.

Furthermore, the circuit element portion 702 has a transparent gate insulation film 708 covering the base protection film 706 and the semiconductor film 707 formed thereon. At the positions corresponding to the channel regions 707*c* of the semiconductor film 707 on the gate insulation film 708 are formed gate electrodes 709 constituted of Al, Mo, Ta, Ti, W, or the like. The gate electrodes 709 and the gate insulation film 708 have first and second transparent interlayer insulation films 711*a* and 711*b* formed thereon. Furthermore, contact holes 712*a* and 712*b* are formed in such a way as to penetrate the first and second interlayer insulation films 711*a* and 711*b* and communicate with the source region 707*a* and the drain region 707*b* of the semiconductor film 707, respectively.

The second interlayer insulation film 711*b* has transparent pixel electrodes 713 made ITO or the like formed thereon in a predetermined pattern, and each of the pixel electrodes 713 is connected to the source region 707*a* via the contact hole 712*a*.

Furthermore, the first interlayer insulation film 711*a* has a power source line 714 disposed thereon. The power source line 714 is connected to the drain region 707*b* via the contact hole 712*b*.

As described above, the circuit element portion 702 has driving thin film transistors 715 connected to the respective pixel electrodes 713 formed therein.

The light-emitting element portion 703 is roughly constituted of functional layers 717 laminated on a plurality of pixel electrodes 713 and bank portions 718 which are provided between sets of the respective pixel electrodes 713 and the functional layers 717 so as to partition the respective functional layers 717.

A light-emitting element is composed of the pixel electrodes 713, the functional layers 717, and the cathode 704 disposed on the functional layers 717. Note that the pixel electrodes 713 are patterned in a substantially rectangular shape in plan view, and the bank portions 718 are formed between the respective pixel electrodes 713.

Each of the bank portions 718 is composed of an inorganic bank layer 718*a* (first bank layer) made of an inorganic material such as SiO, $SiO_2$, or $TiO_2$ and an organic bank layer 718*b* (second bank layer) laminated on the inorganic bank layer 718*a* and is made of a resist such as an acryl resin resist or a polyimide resin resist excellent in thermal resistance and solvent resistance, having a trapezoidal shape in cross section. A part of the bank portion 718 overlies the periphery of the respective pixel electrodes 713.

The respective bank portions 718 have an opening portion 719 formed therebetween, formed to be gradually enlarged upward relative to the pixel electrodes 713.

Each of the functional layers 717 is composed of a hole-injecting/transporting layer 717*a* and a light-emitting layer 717*b* formed on the hole-injecting/transporting layer 717*a*, both lying on the pixel electrode 713 of the opening portion 719 in a laminated state. Note that another functional layer having any other function may be additionally formed, lying adjacent to the light-emitting layer 717*b*. For example, it is possible to form an electron-transporting layer.

The hole-injecting/transporting layer 717*a* serves to transport holes from the pixel electrode 713 side and inject the same into the light-emitting layer 717*b*. The hole-injecting/transporting layer 717*a* is formed after a first composition (functional liquid) containing a material for forming a hole-injecting/transporting layer is ejected. A publicly known material is used as the material for forming a hole-injecting/transporting layer.

The light-emitting layer 717*b* emits light of any one of the colors red (R), green (G), and blue (B) and is formed after a second composition (functional liquid) containing a material for forming a light-emitting layer (light-emitting material) is ejected. It is preferable that a publicly known material insoluble to the hole-injecting/transporting layer 717*a* be used as a solvent of the second composition (nonpolar solvent). Such a nonpolar solvent is used as the second composition of the light-emitting layer 717*b*, thereby making it possible to form the light-emitting layer 717*b* without dissolving the hole-injecting/transporting layer 717*a* again.

According to this configuration, holes injected from the hole-injecting/transporting layer 717*a* and electrons injected from the cathode 704 are reunited so as to emit light in the light-emitting layer 717*b*.

The cathode 704 is formed so as to cover the whole light-emitting element portion 703 and plays an role of passing an electric current to the functional layer 717 together with the pixel electrode 713 as a pair. Note that the cathode 704 has a sealing member (not shown) arranged thereabove.

Referring next to FIGS. 17 to 25, a description will be made about a process of manufacturing the display device 700.

Figure 17:
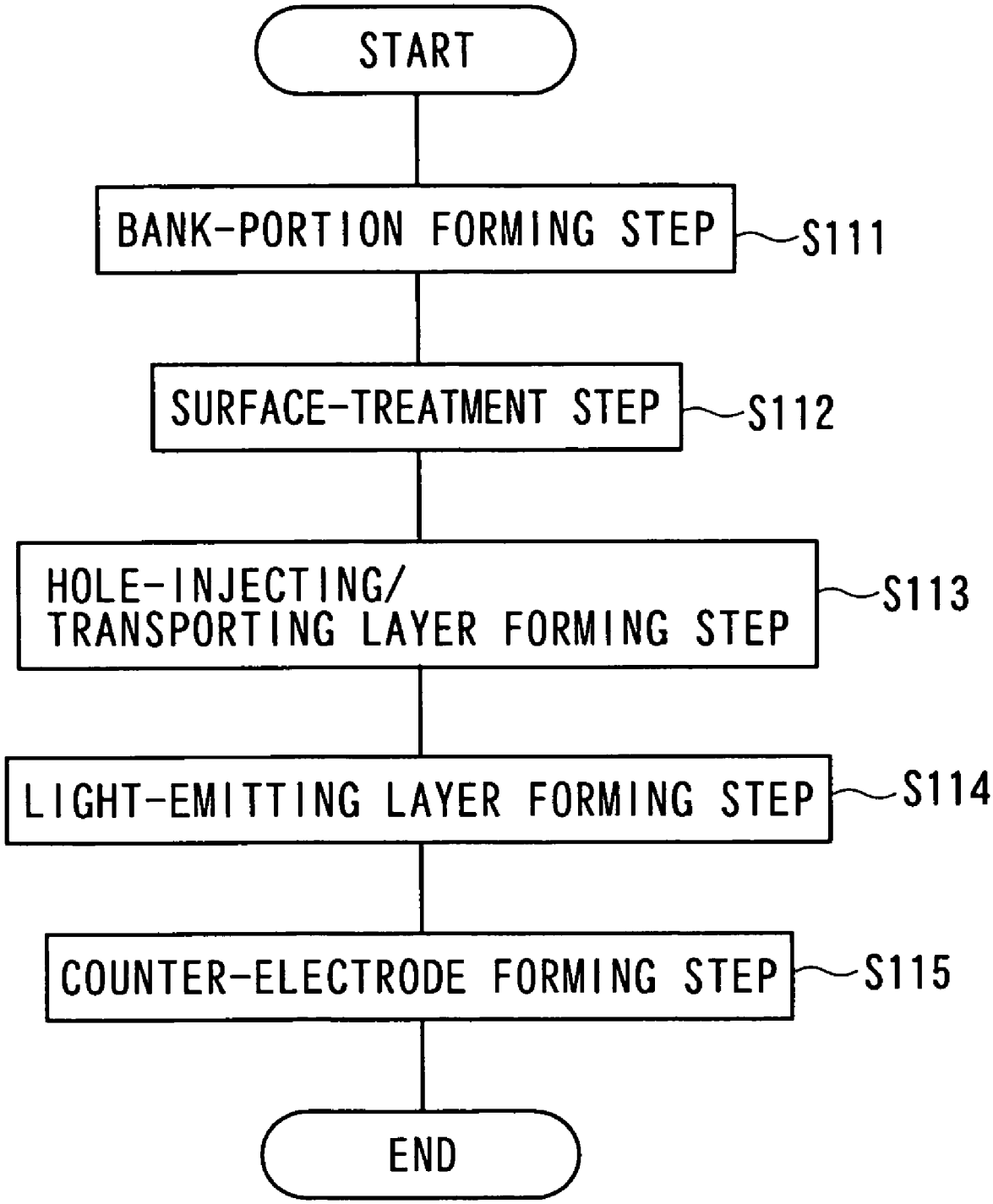
FIG. 17 is a flow chart explaining the steps of manufacturing the display device as an organic EL device.

As shown in FIG. 17, the display device 700 is manufactured by way of a bank-portion forming step (S111), a surface-treatment step (S112), a hole-injecting/transporting layer forming step (S113), a light-emitting layer forming step (S114), and a counter-electrode forming step (S115). Note that the manufacturing process is not limited to that exemplified in the figure, and some steps may be deleted from or added to the process as required.

Figure 18:
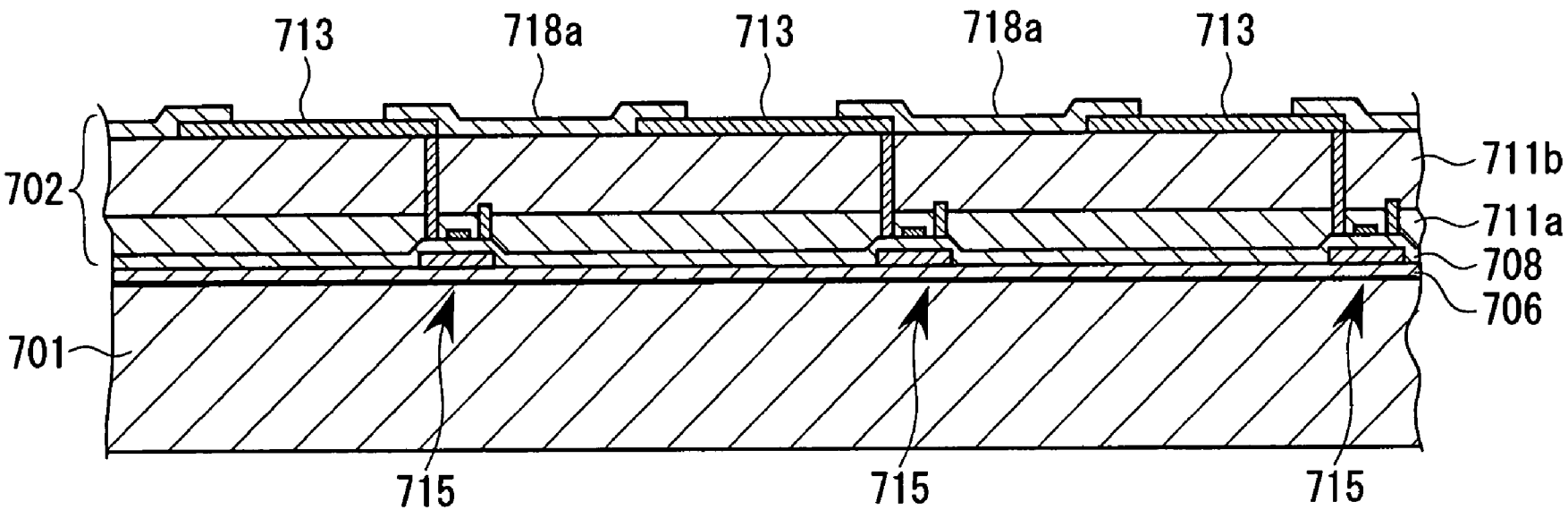
FIG. 18 is a process drawing explaining the formation of an inorganic bank layer.

First, as shown in FIG. 18, the inorganic bank layer 718*a* is formed on the second interlayer insulation film 711*b* in the bank-portion forming step (S111). The inorganic bank layer 718*a* is formed after an inorganic film is formed at its forming position and is then patterned by a photolithographic process or the like. At this time, a part of the inorganic bank layer 718*a* is formed so as to overlap with the periphery of the pixel electrode 713.

Figure 19:
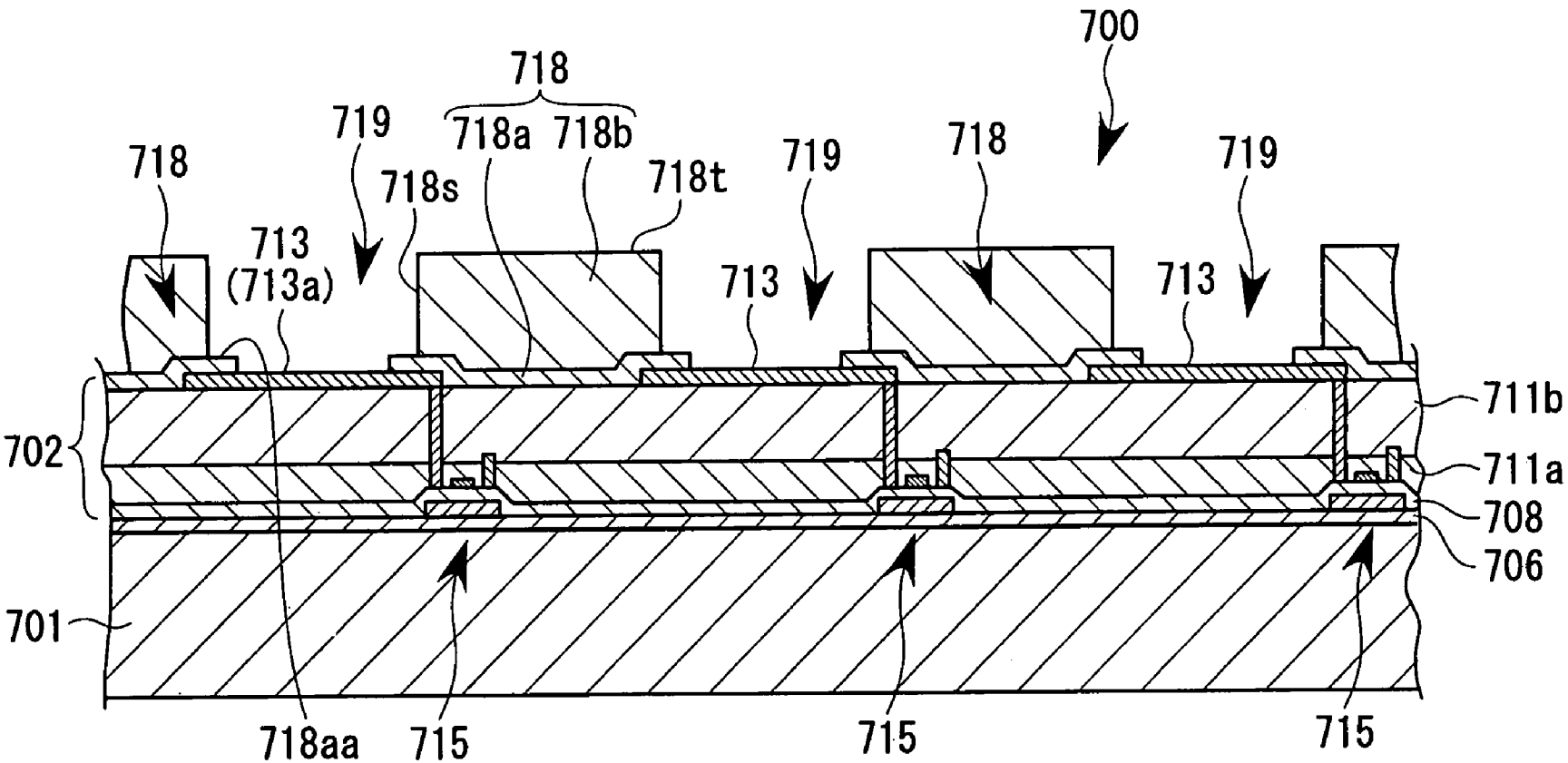
FIG. 19 is a process drawing explaining the formation of an organic bank layer.

After the inorganic bank layer 718*a* is formed, the organic bank layer 718*b* is formed on the inorganic bank layer 618*a* as shown in FIG. 19. The organic bank layer 718*b* is also patterned by the photolithographic process or the like in the same manner as that of the inorganic bank layer 718*a*.

The bank portion 718 is thus formed. In accordance with the formation of the bank, the respective bank portions 718 have the opening portion 719 formed therebetween so as to be opened upward relative to the pixel electrodes 713. The opening portion 719 serves to define a pixel region.

In the surface-treatment step (S112), lyophilic and liquid-repellent treatments are performed. The lyophilic treatment is applied to the regions of a first lamination portion 718*aa* of the inorganic bank layer 718*a* and an electrode surface 713*a* of the pixel electrode 713, and the regions are surface-treated so as to be lyophilic with plasma treatment using, for example, oxygen as a process gas. The plasma treatment serves also to clean ITO constituting the pixel electrode 713.

Furthermore, the liquid-repellent treatment is applied to wall surfaces 718*s* and the top surface 718*t* of the organic bank layer 718*b*, and the surfaces are fluoridized (treated so as to be liquid-repellent) with plasma treatment using, for example, tetrafluoromethane as a process gas.

As a result of the surface treatment step, it is possible to reliably shoot functional liquid droplets into pixel regions when the functional layer 717 is formed with the functional liquid droplet ejection head 252 and prevent the functional liquids shot into the pixel regions from leaking out of the opening portion 719.

According to the above-referenced steps, a display device substrate 700A can be obtained. The display device substrate 700A is mounted on the set table 222 of the liquid droplet ejection apparatus 201 as shown in FIG. 9, and the following hole-injecting/transporting layer forming step (S113) and the light-emitting layer forming step (S114) are hereinafter performed.

Figure 20:
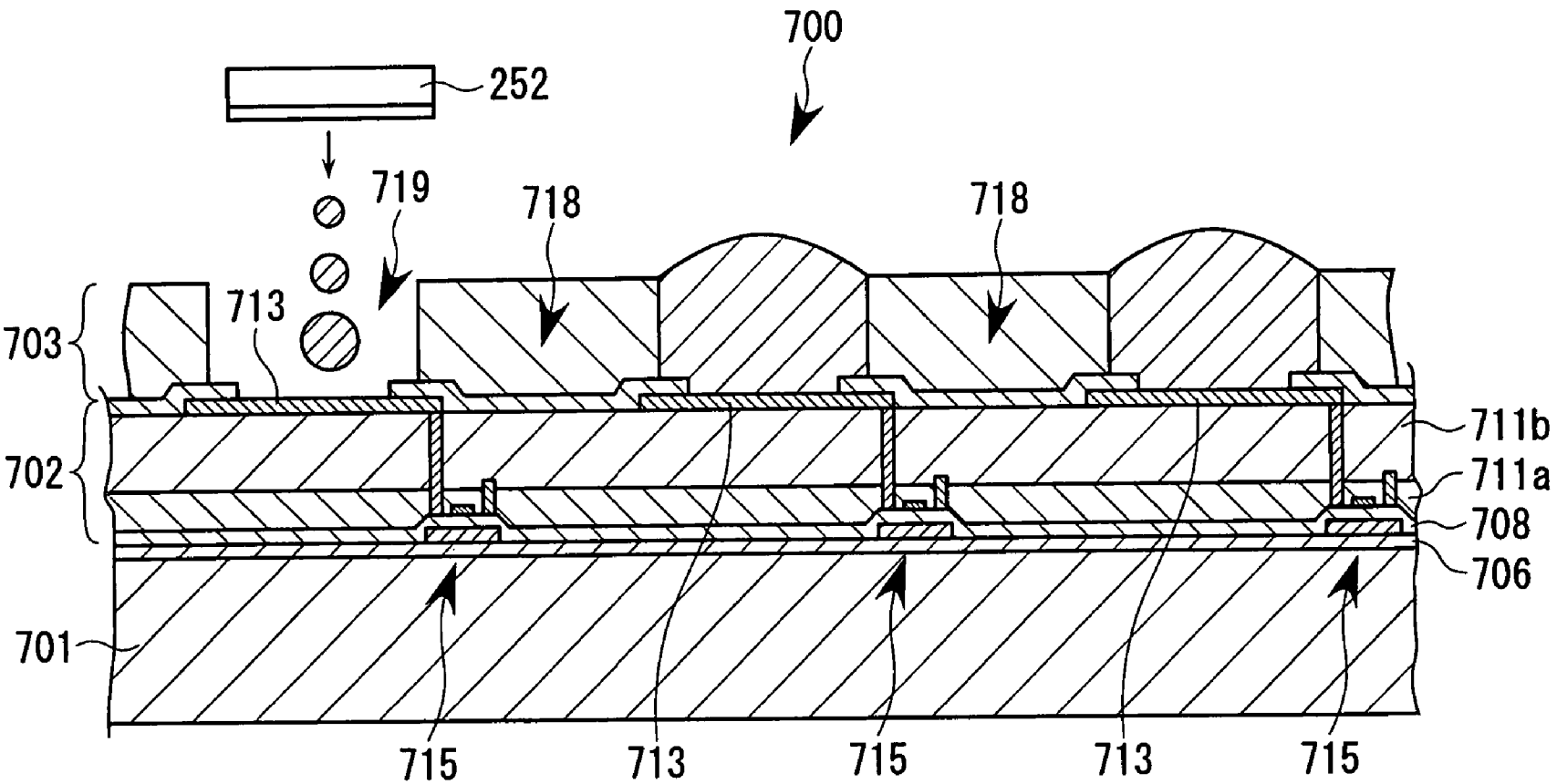
FIG. 20 is a process drawing explaining the steps of forming a hole-injecting/transporting layer.
Figure 21:
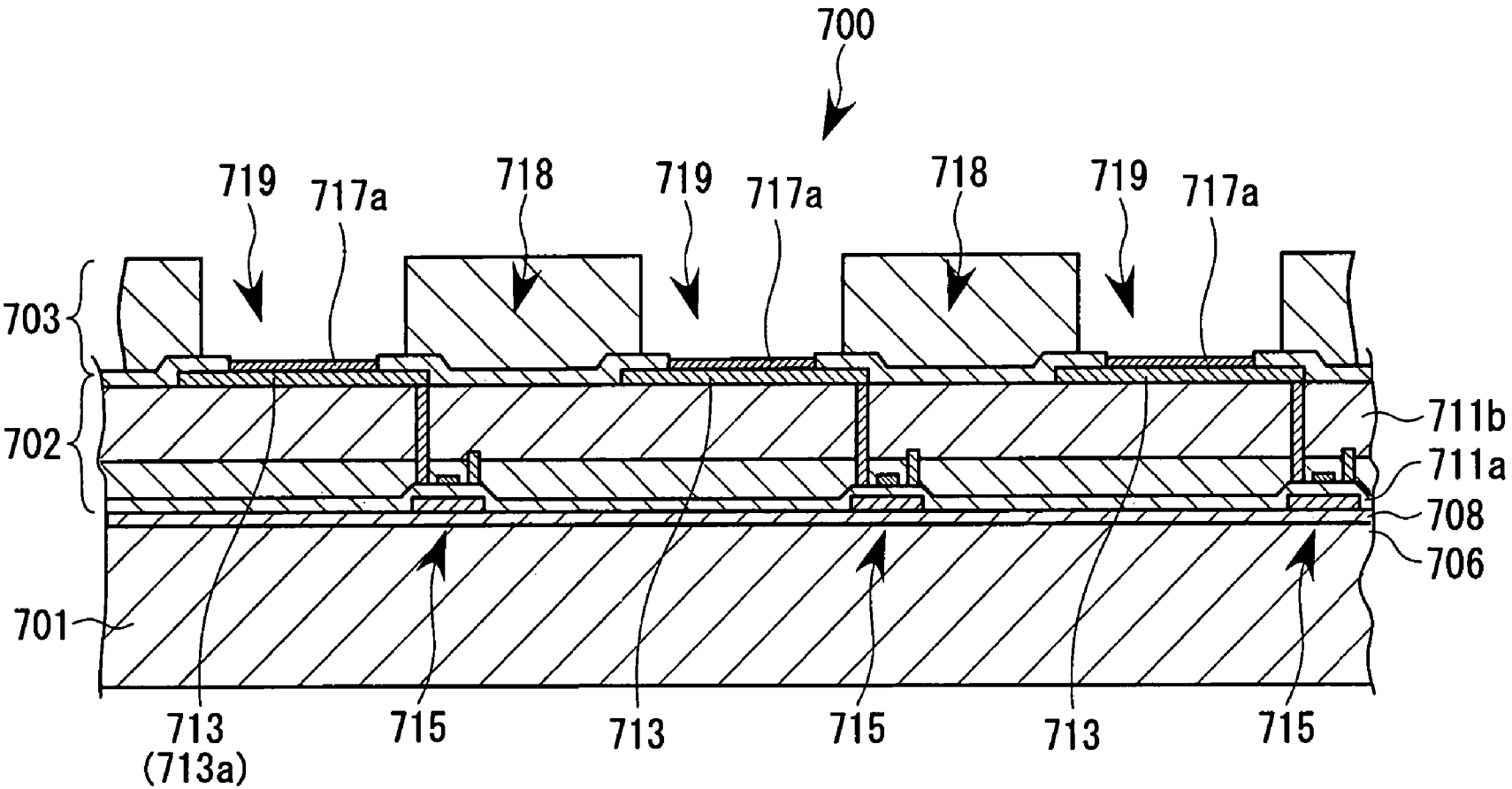
FIG. 21 is a process drawing explaining a state where the hole-injecting/transporting layer is formed.

As shown in FIG. 20, in the hole-injecting/transporting layer forming step (S113), the functional liquid droplet ejection head 252 ejects the first composition containing the hole-injecting/transporting layer forming material in the corresponding opening portion 719 as a pixel region. Subsequently, drying treatment and thermal treatment are performed on the first composition so as to evaporate a polar solvent contained therein and form the hole-injecting/transporting layer 717*a* on the pixel electrode (electrode surface 713*a*) 713 as shown in FIG. 21.

Next, a description will be made about the light-emitting layer forming step (S114). In the light-emitting layer forming step, the nonpolar solvent insoluble to the hole-injecting/transporting layer 717*a* is used as the second composition solvent for use in forming the light-emitting layer so as to prevent the hole-injecting/transporting layer 717*a* from being dissolved again as described above.

On the other hand, however, the hole-injecting/transporting layer 717*a* has a low affinity for the nonpolar solvent. Therefore, even if the second composition containing the nonpolar solvent is ejected on the hole-injecting/transporting layer 717*a*, there is a possibility that the hole-injecting/transporting layer 717*a* cannot be brought into intimate contact with the light-emitting layer 717*b*, or that the light-emitting layer 717*b* cannot be evenly coated.

To enhance the affinity of the surface of the hole-injecting/transporting layer 717*a* with respect to the nonpolar solvent and the light-emitting layer forming material, it is preferable that the surface treatment (surface modification treatment) be performed before the light-emitting layer is formed. In the surface treatment, a surface modification material as a solvent identical with or similar to the nonpolar solvent of the second composition for use in forming the light-emitting layer is coated on the hole-injecting/transporting layer 717*a* and then dried.

Such treatments make it easy for the surface of the hole-injecting/transporting layer 717*a* to soak into the nonpolar solvent, and the second composition containing the light-emitting layer forming material can be evenly coated on the hole-injecting/transporting layer 717*a* in the following steps.

Figure 22:
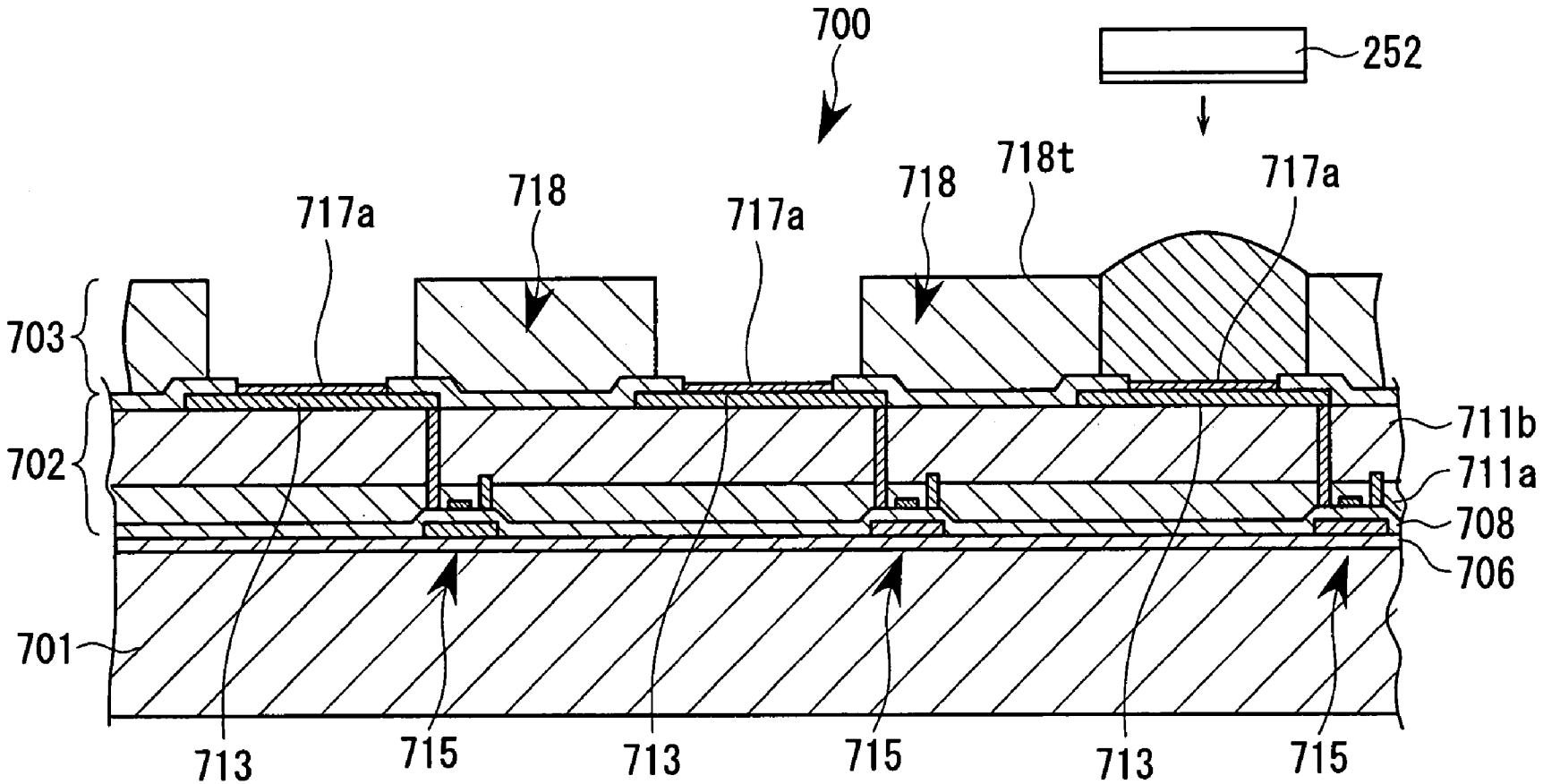
FIG. 22 is a process drawing explaining the steps of forming a blue light-emitting layer.

Next, as shown in FIG. 22, a predetermined amount of the second composition containing the light-emitting layer forming material corresponding to any one of the colors (blue (B) in the example of FIG. 22) is implanted in the pixel region (opening portion 719) as a functional liquid droplet. The second composition implanted in the pixel region spreads over the hole-injecting/transporting layer 717*a* and is filled in the opening portion 719. Note that, in case that the second composition is shot on the top surface 718*t* of the bank portion 718 away from the pixel region, it will easily find its way into the opening portion 719 since the liquid-repellent treatment has been previously applied to the top surface 718*t* as described above.

Figure 23:
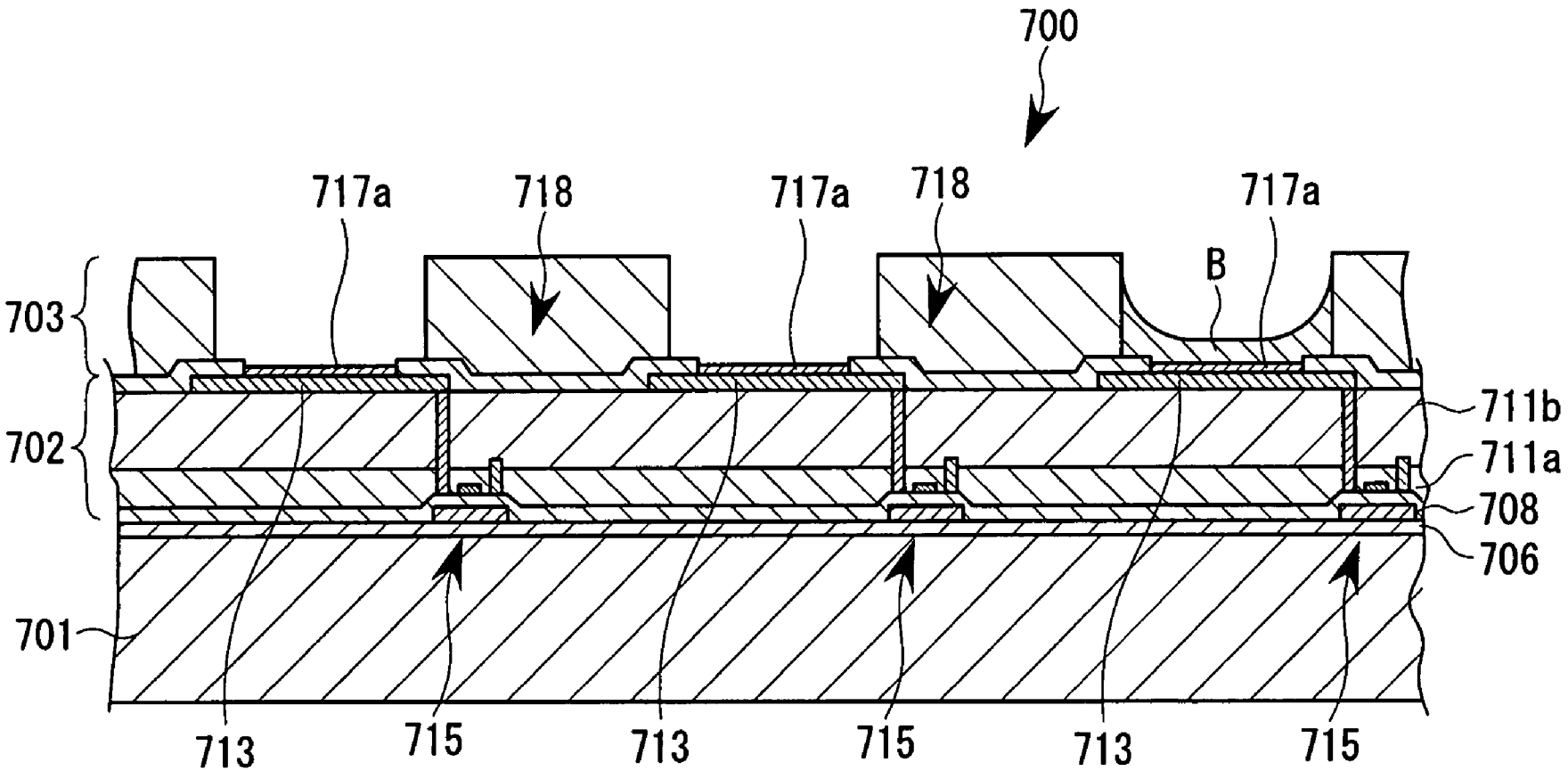
FIG. 23 is a process drawing explaining a state where the blue light-emitting layer is formed.

Subsequently, the second composition ejected is dried through a drying step, etc., making the nonpolar solvent contained in the second composition evaporate, and then forming the light-emitting layer 717*b* on the hole-injecting/transporting layer 717*a* as shown in FIG. 23. In the case of this figure, the light-emitting layer 717*b* corresponding to the blue color (B) is formed.

Figure 24:
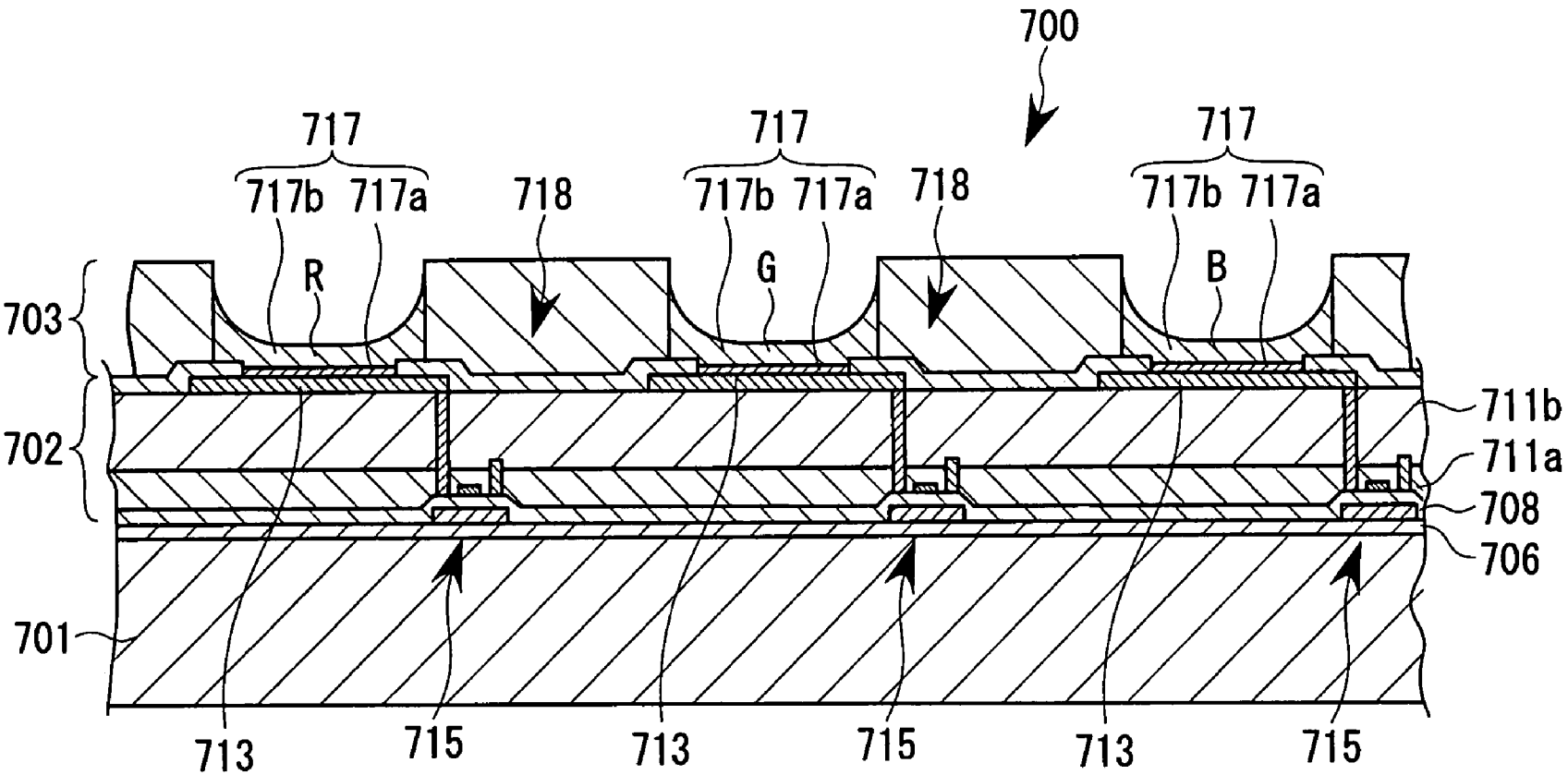
FIG. 24 is a process drawing explaining a state where light-emitting layers of each color are formed.

Similarly, as shown in FIG. 24, steps similar to that of the light-emitting layer 717*b* corresponding to the blue color (B) as described above are sequentially performed with the functional liquid droplet ejection head 252, and the light-emitting layers 717*b* corresponding to the other colors (red (R) and green (G)) are formed. Note that the order of forming the light-emitting layers 717*b* is not limited to the exemplified one, and the light-emitting layers may be formed in any order. For example, the order can be determined in accordance with the light-emitting layer forming material. Furthermore, examples of arrangement patterns for the three colors of R, G, and B include a strip arrangement, a mosaic arrangement, a delta arrangement, or the like.

In the manner as described above, the functional layer 717, namely, the hole-injecting/transporting layer 717*a* and light-emitting layer 717*b* are formed on each of the pixel electrodes 713. Then, the step is moved to the counter-electrode forming step (S115).

Figure 25:
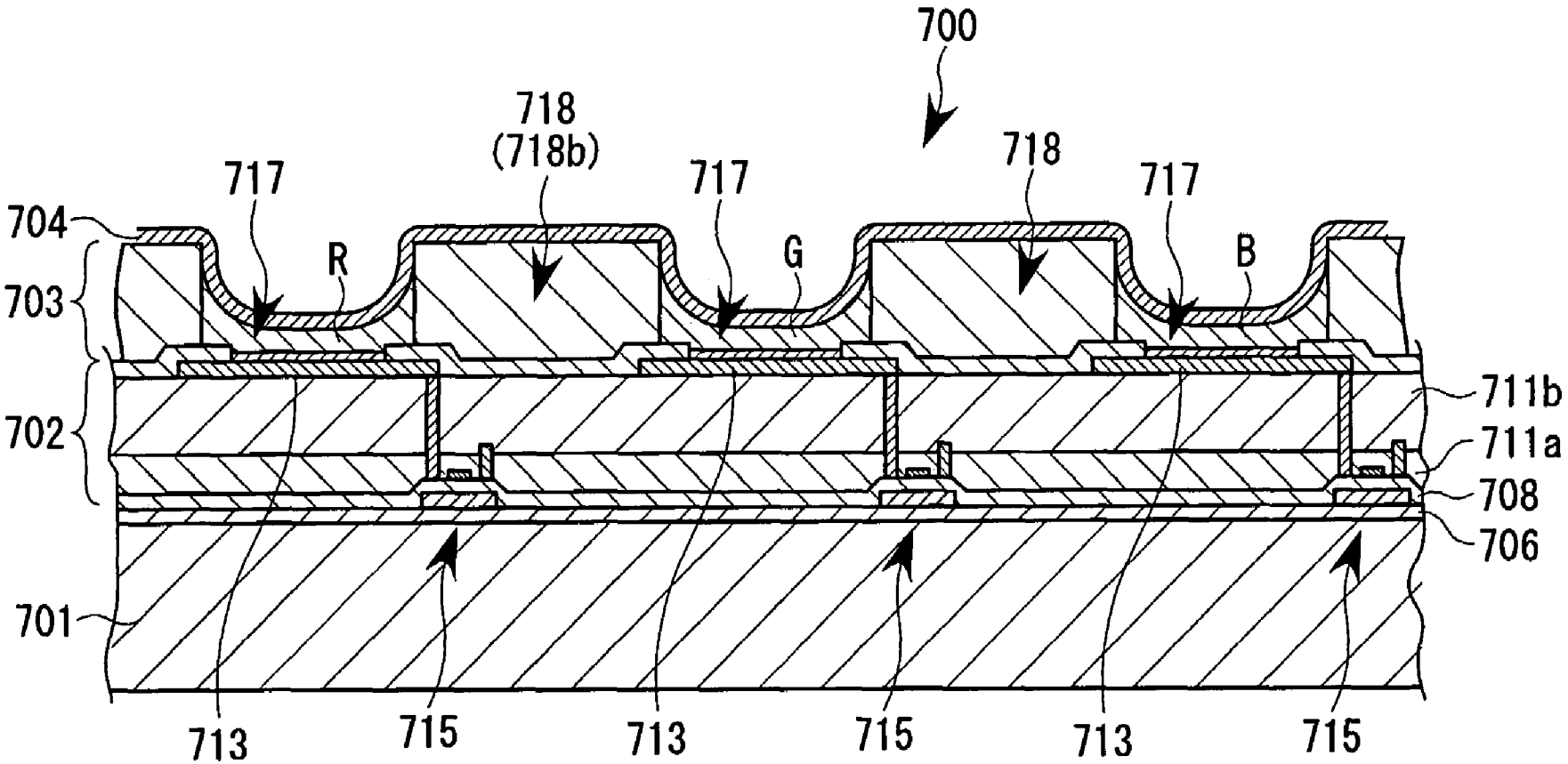
FIG. 25 is a process drawing explaining the formation of a cathode.

In the counter-electrode forming step (S115), as shown in FIG. 25, the cathode 704 (counter electrode) is formed on the whole surfaces of the light-emitting layers 717*b* and the organic bank layers 718*b* by, for example, vapor deposition, spattering, CVD (chemical vapor deposition), or the like. In the embodiment, the cathode 704 has, for example, a calcium layer and an aluminum layer laminated therein.

The cathode 704 has properly disposed thereon an Al film or an Ag film as an electrode and a protection layer made of $SiO_2$, SiN, or the like for preventing the Al film or the Ag film from being oxidized.

After the cathode 704 is thus formed, when other treatments such as sealing treatment for sealing the top portion of the cathode 704 with a sealing member and wiring treatment are applied, the display device 700 is obtained.

Figure 26:
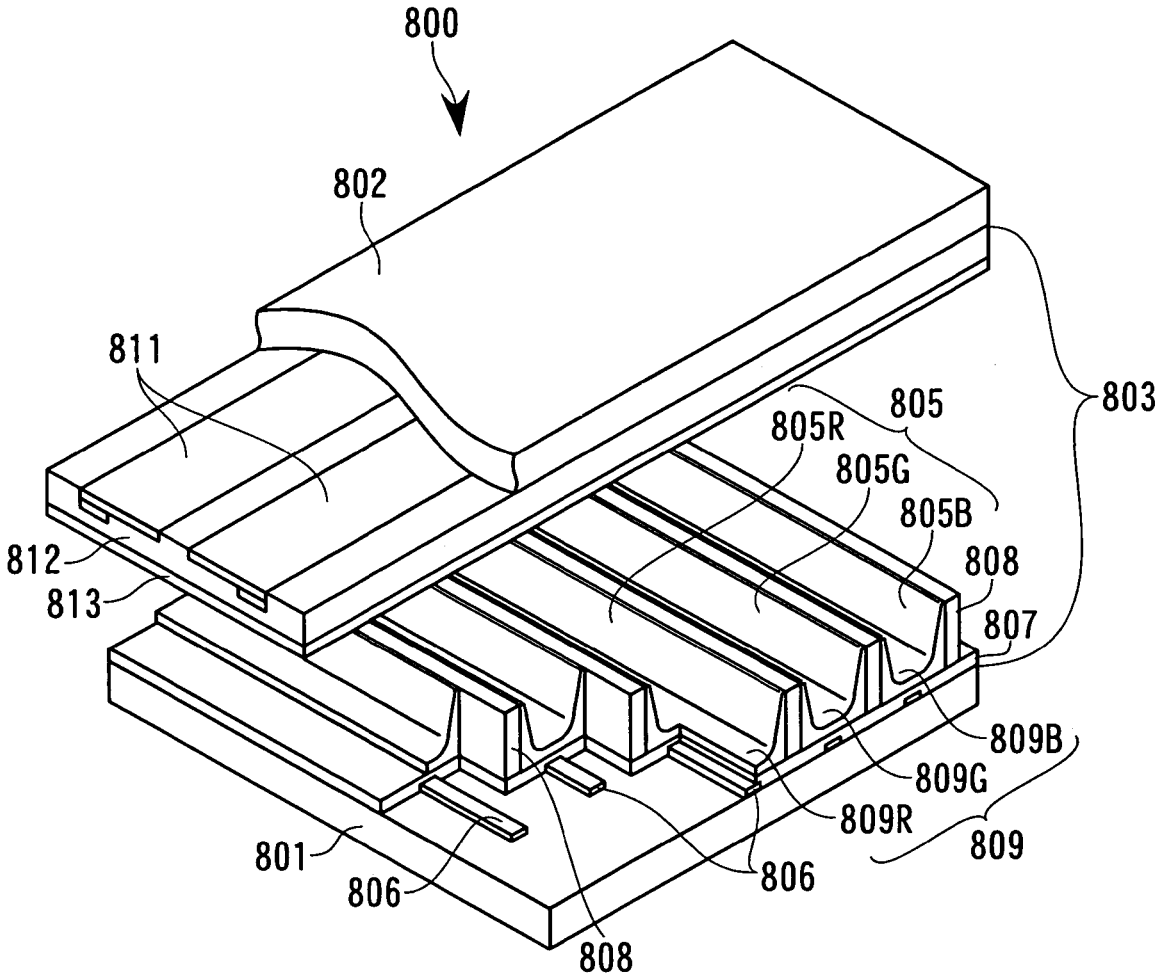
FIG. 26 is an exploded perspective view of an essential part of a display device as a plasma display panel (PDP device).

Next, FIG. 26 is an exploded perspective view of an essential part of a plasma display panel (PDP device: hereinafter, simply referred to as a display device 800). Note that the display device 800 is shown in a state where a part thereof is cut away.

The display device 800 is roughly constituted of mutually opposing first and second substrates 801 and 802 and a discharge display portion 803 held between the first and second substrates. The discharge display portion 803 is composed of a plurality of discharge chambers 805. Of the plurality of discharge chambers 805, a set of three discharge chambers 805 of a red discharge chamber 805R, a green discharge chamber 805G, and a blue discharge chamber 805B is arranged so as to constitute one pixel.

The first substrate 801 has address electrodes 806 formed on the top surface thereof in a stripe pattern at predetermined intervals, and a dielectric layer 807 is formed to cover the top surfaces of the address electrodes 806 and the first substrate 801. The dielectric layer 807 has partition walls 808 provided thereon in a standing manner, each being arranged between the respective address electrodes 806 and extending along the corresponding address electrodes 806. The partition walls 808 include those extending along the address electrodes 806 as shown in the figure and those (not shown) extending orthogonal to the address electrodes 806.

Areas partitioned by the partition walls 808 serve as the discharge chambers 805.

Each of the discharge chambers 805 has a phosphor 809 arranged therein. The phosphor 809 emits fluorescent light of any one of the colors red (R), green (G), or blue (B). The red, green, and blue discharge chambers 805R, 805G, and 805B have red, green, and blue fluorescent materials 809R, 809G, and 809B arranged at the bottom portions thereof, respectively.

The second substrate 802 has a plurality of display electrodes 811 formed on the bottom surface thereof, as shown in the figure, so as to extend in the direction orthogonal to the address electrodes 806 in a stripe pattern at predetermined intervals. To cover the display electrodes, a dielectric layer 812 and a protection film 813 made of MgO or the like are formed.

The first substrate 801 and the second substrate 802 are bonded to each other in a state where the address electrodes 806 and the display electrodes 811 lie orthogonal to each other. Note that the address electrodes 806 and the display electrodes 811 are connected to respective alternators (not shown).

When each of the electrodes 806 and 811 is energized, the phosphors 809 are excited to emit light in the discharge display portion 803, thereby providing color display.

According to the embodiment, the address electrodes 806, the display electrodes 811, and the phosphors 809 can be formed with the liquid droplet ejection apparatus 201 as described in FIG. 9. Hereinafter, a description will be made about a step of forming the address electrodes 806 of the first substrate 801.

In this case, the following step is performed in a state where the first substrate 801 is mounted on the set table 222 of the liquid droplet ejection apparatus 201.

First, a liquid material (functional liquid) containing a material for forming a conductive-film wiring is, as a functional liquid droplet, shot into a region of forming an address electrode with the functional liquid droplet ejection heads 252. The liquid material contains conductive fine particles made of a metal or the like, dispersed into a disperse medium, as a material for forming a conductive-film wiring. As the conductive fine particles, metal fine particles containing, for example, gold, silver, copper, palladium, nickel, and a conductive polymer or the like are used.

When replenishment of the liquid material in the whole region of forming address electrodes to be objected is finished, the ejected liquid material is subjected to drying treatment and the disperse medium contained in the liquid material is evaporated, thereby forming the address electrodes 806.

Meanwhile, as the address electrodes 806 are formed in the above, the display electrodes 811 and the phosphors 809 can also be formed by way of each of the above-referenced steps.

To form the display electrodes 811, a liquid material (functional liquid) containing a material for forming a conductive film wiring is, as a functional liquid droplet, shot into a region of forming a display electrode in the same manner as that of the address electrodes 806.

To form the phosphors 809, a liquid material (functional liquid) containing a luminescent material corresponding to each of the colors, R, G, and B, is ejected from the functional liquid droplet ejection heads 252 and shot into the discharge chambers 805 of the corresponding colors.

Figure 27:
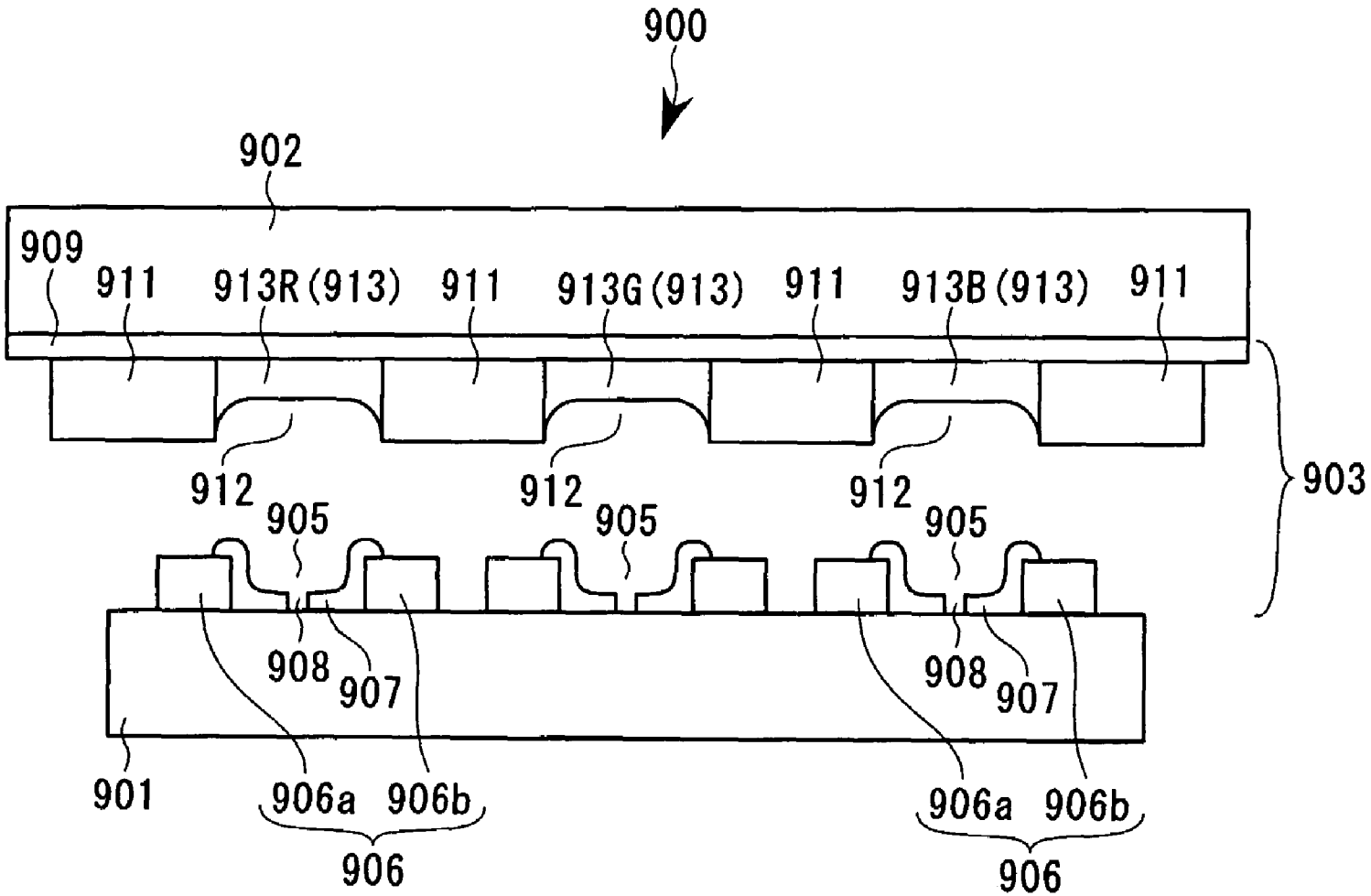
FIG. 27 is a cross section of an essential part of a display device as an electron emission device (FED device).

FIG. 27 is a cross section of an essential part of an electron emission device (also called FED or SED, hereinafter simply referred to as a display device 900). Note that, in the figure, the display device 900 is in a state where a part thereof is shown in cross section.

The display device 900 is roughly constituted of mutually opposing first and second substrates 901 and 902, and a field-emission display portion 903 held between the first and second substrates. The field-emission display portion 903 is composed of a plurality of electron-emitting portions 905 arranged in a matrix pattern.

The first substrate 901 has first and second element electrodes 906*a* and 906*b* constituting cathode electrodes 906 formed on the top surface thereof so as to be mutually orthogonal to each other. Furthermore, in a part partitioned by each of the first and second element electrodes 906*a* and 906*b*, a conductive film 907 having a gap formed therein is formed. In other words, the first element electrodes 906*a*, the second element electrodes 906*b*, and the conductive films 907*c* constitute the plurality of electron-emitting portion 905. Each of the conductive films 907 is made of palladium oxide (PdO) or the like, and the gap 908 is formed, for example, by means of foaming after the conductive film 907 is formed.

The second substrate 902 has anode electrodes 909 formed on the bottom surface thereof so as to oppose the cathode electrodes 906. Each of the anode electrodes 909 has bank portions 911 formed in a lattice pattern on the bottom surface thereof. In each of opening portions 912 oriented downward surrounded by the bank portions 911, phosphors 913 are arranged so as to correspond to the electron-emitting portions 905. The phosphors 913 emit fluorescent light of any one of the colors red (R), green (G), or blue (B). In each of the opening portions 912, red, green, and blue fluorescent materials 913R, 913G, and 913B are arranged in the above-referenced predetermined pattern.

The first substrate 901 and the second substrate 902 thus formed are bonded to each other so as to have a small gap therebetween. In the display device 900, an electron emitted from the first element electrodes 906*a* or the second element electrodes 906*b* as a cathode hits upon the phosphor 913 formed on the anode electrode 909 as an anode via the conductive film (gap 908) 907 so as to be excited to emit light, thereby providing color display.

In the same manner as those of other embodiments, the first element electrodes 906*a*, the second element electrodes 906*b*, the conductive films 907, and the anode electrodes 909 can be formed with the liquid droplet ejection apparatus 201, and the phosphors 913R, 913G, 913B corresponding to each of the colors can be formed with the liquid droplet ejection apparatus 201.

Figure 28A:
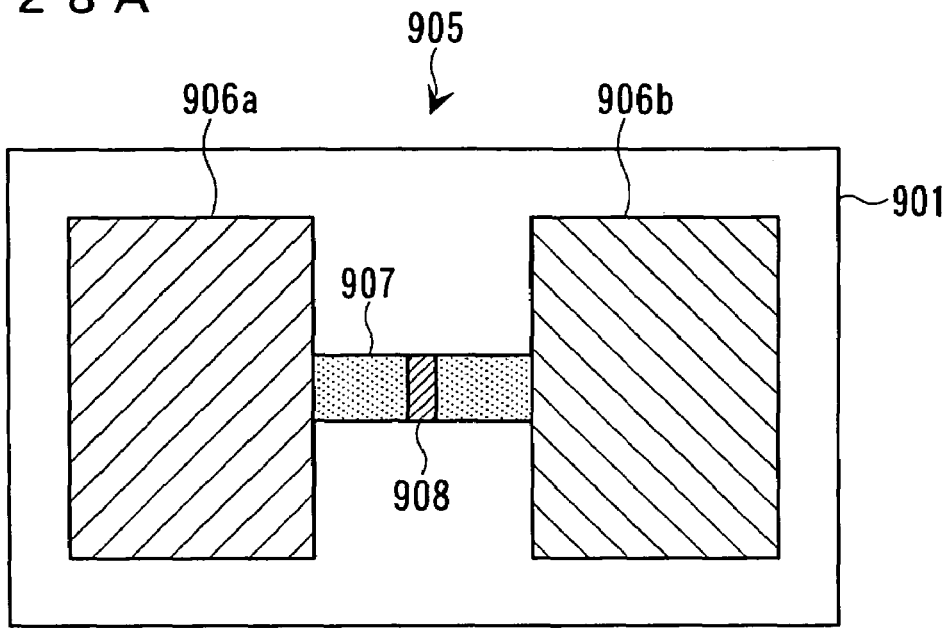
FIGS. 28A and 28B are plan views, each showing an electron-emitting portion and its surrounding components of the display device and a method of forming thereof.
Figure 28B:
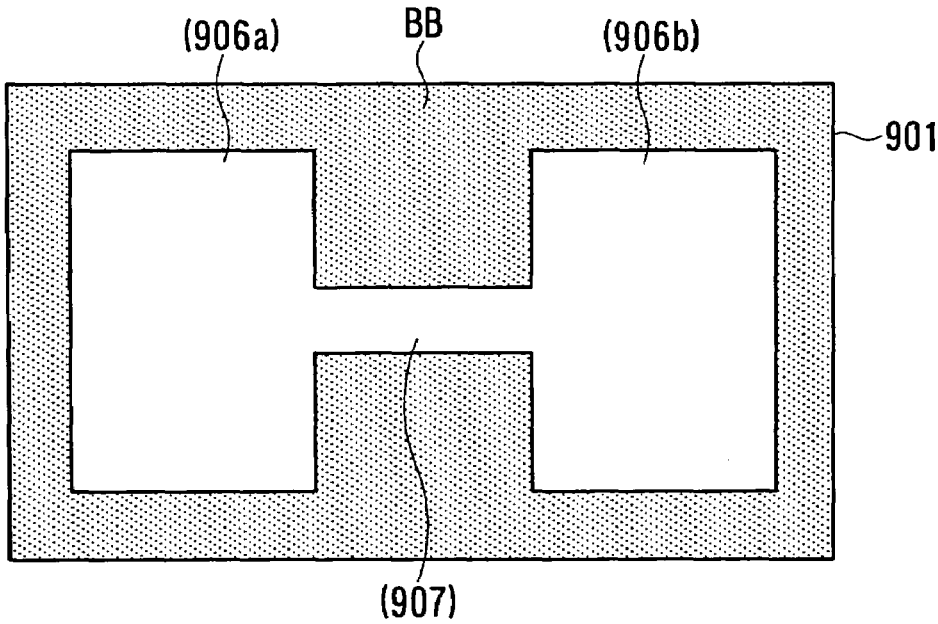

The first element electrode 906*a*, the second element electrode 906*b*, and the conductive film 907 are formed in a plan shape as shown in FIG. 28A. To deposit the first element electrode, the second element electrode, and the conductive film, a bank portion BB is formed as shown in FIG. 28B (by means of photolithography process), while a portion where the first element electrode 906*a*, the second element electrode 906*b*, and the conductive film 907 are to be formed is left intact. Next, the first element electrode 906*a* and the second element electrode 906*b* are formed (by an ink-jet method of the liquid droplet ejection apparatus 1) in a groove portion constituted by the bank portion BB, the solvent used therefor is dried to deposit the above components, and then the conductive film 907 is formed (by an ink-jet method of the liquid droplet ejection apparatus 201). After the conductive film 807 is deposited, the bank portion BB is removed (by an ashing process), and then the above-referenced forming process is performed. Note that, in the same manner as the organic EL device as described above, it is preferable that the first and second substrates 901 and 902 and the bank portion 911 and BB be subjected to lyophilic treatment and liquid-repellent treatment, respectively.

Furthermore, examples of electro-optical devices include devices for forming metal wiring, lens, resist, light diffuser, or the like. Various electro-optical devices can efficiently be manufactured when the above-referenced liquid droplet ejection apparatus 201 is applied for manufacturing the same.

It is further understood by those skilled in the art that the foregoing is the preferred embodiment of the invention, and that various changes and modifications may be made without departing from the spirit and scope thereof.

What is claimed is:

1. A method of controlling a functional liquid supply apparatus, the apparatus having a plurality of functional liquid tanks each storing therein a functional liquid different in kind from one another, the functional liquid tanks being respectively pressurized by a plurality of corresponding pressurizing pumps so as to supply each kind of the functional liquid under pressure from the respective functional liquid tanks to the functional liquid droplet ejection head which ejects the functional liquid droplets, the method comprising:

a pressure-loss computing step for computing a pressure loss of each kind of the functional liquid flowing through respective functional liquid passages which extend from the respective functional liquid tanks to the functional liquid droplet ejection head;

a supply-pressure computing step for computing a supply pressure of each kind of the functional liquid with the pressure loss taken into consideration so that an in-head pressure of each kind of the functional liquid in the functional liquid droplet ejection head becomes a set pressure which is respectively set in advance; and an independent-pressurizing step for independently pressurizing the plurality of the functional liquid tanks based on the computed supply pressure, wherein the pressure-loss computing step further comprises:

a viscosity-data inputting step for inputting viscosity data of the various kinds of functional liquids; and a pressure-loss setting step for setting the pressure loss based on the inputted viscosity data and pressure-loss setting information in which the viscosity data and the pressure loss are correlated with each other.

2. The method according to claim 1, wherein the supplying under pressure of the functional liquids is performed by driving the pressurizing pumps by pressurizing each of the functional liquid tanks so as to maintain a predetermined working pressure; and wherein the independent-pressurizing step comprises:

a pressure-detecting step for detecting as to whether the functional liquid supply pressure, which is made to be the working pressure, reaches a lower-limit pressure of the working pressure; and a pressurizing step for pressurizing the functional liquid tank that has not reached the lower-limit pressure to an upper-limit pressure of the working pressure.

3. A functional liquid supply apparatus having a plurality of functional liquid tanks each storing therein a functional liquid different in kind from one another, and a plurality of corresponding pressurizing pumps to pressurize the functional liquid tanks so as to supply each kind of the functional liquid under pressure from the respective functional liquid tanks to the functional liquid droplet ejection head which ejects the functional liquid droplets, the apparatus comprising:

a pressure-loss computing means for computing a pressure loss of each kind of the functional liquid flowing through respective functional liquid passages which extend from the respective functional liquid tanks to the functional liquid droplet ejection head;

a supply-pressure computing means for computing a supply pressure of each kind of the functional liquid with the pressure loss taken into consideration so that an in-head pressure of each kind of the functional liquid in the functional liquid droplet ejection head becomes a set pressure which is respectively set in advance; and an independent-pressurizing means for independently pressurizing the plurality of the functional liquid tanks based on the computed supply pressure, wherein the pressure-loss computing means further comprises:

a viscosity-data inputting means for inputting viscosity data of the various kinds of functional liquids; and pressure-loss setting means for setting the pressure loss based on the inputted viscosity data and pressure-loss setting information in which the viscosity data and the pressure loss are correlated with each other.

4. The apparatus according to claim 3, wherein the supplying under pressure of the functional liquids is performed by driving the pressurizing pumps to pressurize each of the functional liquid tanks so as to maintain a predetermined working pressure; and wherein the independent-pressurizing means comprises:

a pressure-detecting means for detecting as to whether the functional liquid supply pressure, which is made to be the working pressure, reaches a lower-limit pressure of the working pressure; and a pressurizing means for pressurizing the functional liquid tank that has not reached the lower-limit pressure to an upper-limit pressure of the working pressure.

5. A liquid droplet ejection apparatus comprising the functional liquid supply apparatus according to claim 3, the liquid droplet ejection apparatus moving the functional liquid droplet ejection head relative to an imaging target, and performing imaging on the imaging target.

6. An electro-optical device manufactured by using the liquid droplet ejection apparatus according to claim 5, comprising a film-forming portion formed with the functional liquid droplets on the imaging target.

7. An electronic device comprising the electro-optical device according to claim 6.

* * * * *